US008387332B2

(12) United States Patent
Piano

(10) Patent No.: US 8,387,332 B2
(45) Date of Patent: Mar. 5, 2013

(54) STRUCTURE OF MODULAR FRAME FOR PARTITIONING WALL

(75) Inventor: Renzo Piano, Turate (IT)

(73) Assignee: Unifor S.p.A., Turate, Como (IT)

( * ) Notice: Subject to any disclaimer, the term of this patent is extended or adjusted under 35 U.S.C. 154(b) by 214 days.

(21) Appl. No.: 12/815,744

(22) Filed: Jun. 15, 2010

(65) Prior Publication Data

US 2011/0138732 A1 Jun. 16, 2011

(30) Foreign Application Priority Data

Jun. 15, 2009 (IT) ..... MI2009A001055

(51) Int. Cl.
*E04C 2/38* (2006.01)

(52) U.S. Cl. ..... 52/656.2; 52/204.1; 52/206; 52/207; 52/210; 52/67; 52/204.71; 52/474; 52/481.1; 52/762; 52/763; 52/764; 52/780

(58) Field of Classification Search ..... 52/67, 204.1, 52/206, 207, 210, 204.71, 474, 481.1, 762–764, 52/780

See application file for complete search history.

(56) References Cited

U.S. PATENT DOCUMENTS 5,277,512 A * 1/1994 Dwillies ..... 403/348
6,032,423 A * 3/2000 Takemura et al. ..... 52/235
7,454,867 B2 * 11/2008 Nicoletti ..... 52/238.1
7,478,504 B2 * 1/2009 Huebner et al. ..... 52/238.1
2004/0025459 A1 2/2004 Huebner et al.
2006/0179788 A1 8/2006 Nicoletti

* cited by examiner

*Primary Examiner* — William Gilbert
*Assistant Examiner* — Patrick Maestri
(74) *Attorney, Agent, or Firm* — Shoemaker and Mattare

(57) ABSTRACT

A modular frame structure (1) for a wall made of glass or other pane material includes:

a lower side or base (2) suitable to receive and lock an edge portion of a pane, an upper side or cross member (4) suitable to receive and lock an edge portion of a pane, one or more posts (6) suitable to receive and lock a portion of a pane, connecting means (8), suitable to guarantee a connection between posts (6) and lower (2) and upper (4) sides, in which:

posts (6) comprise a reinforcing bar (9) suitable to confer stiffness to frame structure (1), connecting means (8) comprise a first undercut coupling seat (27) obtained on lower side (2), a second undercut coupling seat (28) obtained on upper side (4), first coupling portion (29) being insertable in first undercut (27), second coupling portion (30) being insertable in second undercut (28).

10 Claims, 26 Drawing Sheets

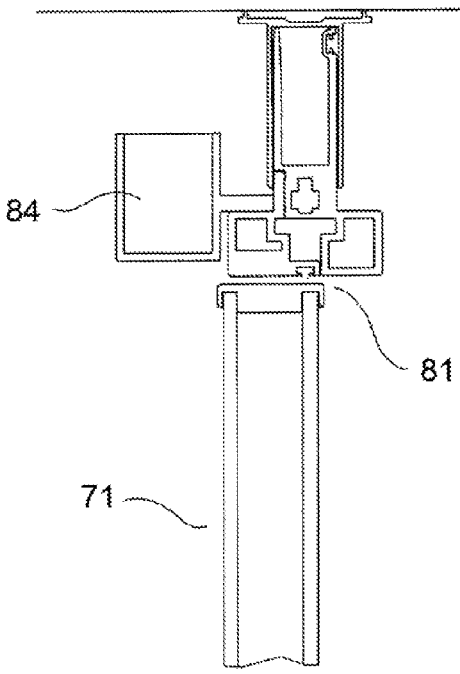
FIG. 21A
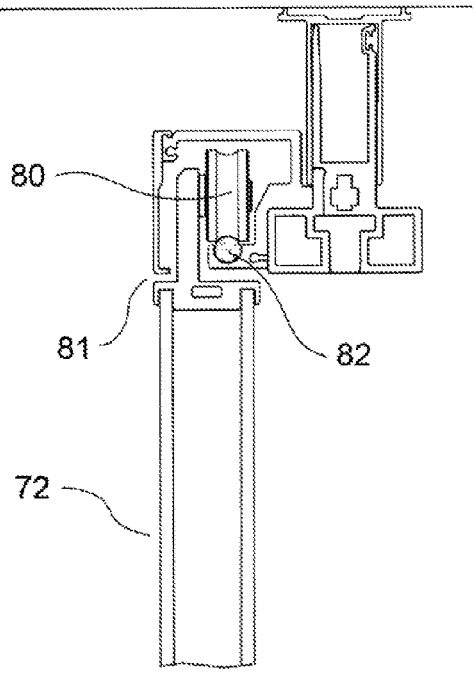
FIG. 21B
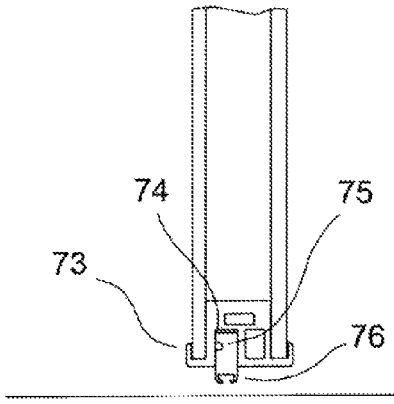
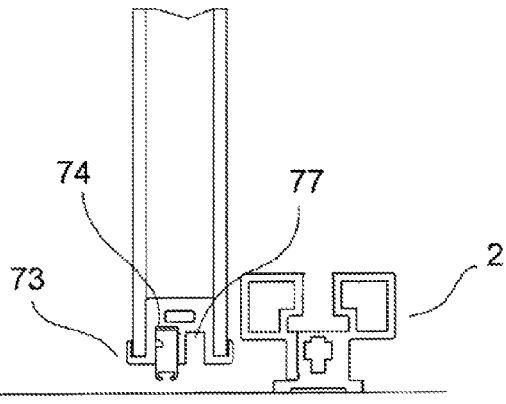

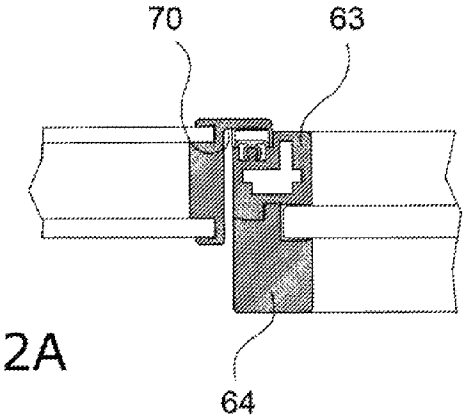
FIG. 22A
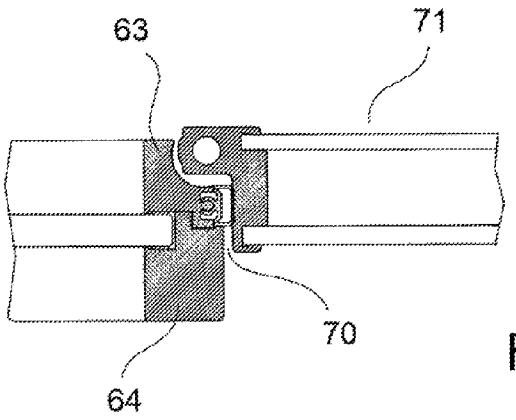
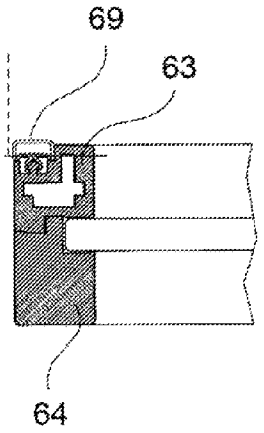
FIG. 22B
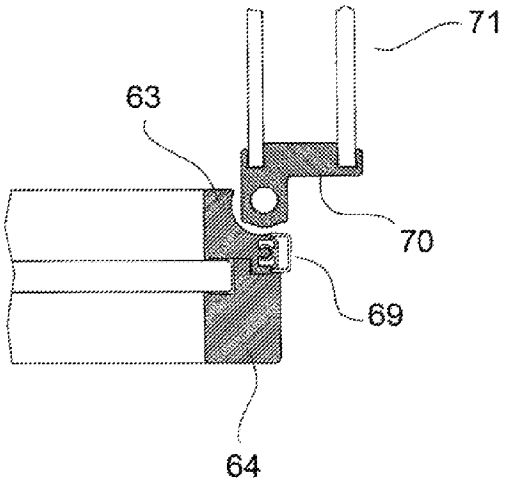

STRUCTURE OF MODULAR FRAME FOR PARTITIONING WALL

BACKGROUND

1. Technical Field

The present invention refers to a modular frame for moveable wall made of glass or other pane material, comprising a base or lower side provided with a pane seat for receiving and locking a portion of a pane, a cross member or upper side also provided with a pane seat, one or more posts forming the sides of the frame, provided with at least one pane seat, and connecting means allowing a removable connection between the posts and the lower and upper sides.

2. Description of Related Prior Art

The modular frames for moveable wall are normally used for partitioning a room into different environments, in cases where one wants to avoid performing an invasive modification intervention of the plan of the room, for example by raising a partitioning wall.

The frames of the prior art are usually made up of a plurality of upper cross members fixed onto the ceiling, vertically overlying a plurality of bases fixed onto the floor, connected to a plurality of posts that form the sides of the frame.

The post is fixed onto the cross member and onto the base through corner connection means.

Each of these sides of the frame (cross members, bases and posts) is usually made up of snap-couplable window/door frames or window/door sections made up of two portions, usually sectioned, connected through snap-fit means, which in the assembled configuration form a pane compartment configured to accommodate an edge portion of the pane.

The pane compartment of the base also accommodates a support element, suitable to support the pane in the operating position thereof.

The assembly of the wall firstly occurs by fixing a cross member onto the ceiling, vertically overlying a base fixed onto the floor. A post is thus connected to cross member and base. The pane is placed on the support element of the base in the vertical operating position thereof. Subsequently snap-fitting window/door frames are assembled, in such a manner that the edge portions of the pane are accommodated in the pane compartments. The method described up to now is repeated in such a manner to adjacently position a new pane to the previous one, progressively forming the wall.

Though satisfactory from various points of view, the frame structure of the aforedescribed type reveals various drawbacks.

First and foremost, the aforedescribed frame structure does not provide for the possibility to compensate possible relative vertical positioning errors between the cross member and the base during assembly. This implies employing skilled manpower and also increases the assembly times.

The snap-fitting window/door frames forming the sides of the frame, do not guarantee constant and repeatable transverse pressure into the pane. This may lead to the creation of shearing stress gradients on the pane, which are particularly dangerous in case of panes made of fragile material, such as glass.

Furthermore, the snap-fitting window/door frames used do not have high mechanical resistance, on condition of not overdimensioning the thickness of the sides of the frame which would otherwise jeopardize the aesthetic quality of the wall, to the detriment of the overall safety in case of application of heavy panes, such as the soundproof multilayer panels.

Lastly, the frame structure described above is characterised by considerable assembly complexity, which would make it unsuitable for solutions in which the moveable wall is to be disassembled and subsequently reassembled frequently, such as for example in offices.

Thus, the object of the present invention is that of providing a modular frame structure for moveable wall made of glass or other pane material having high mechanical resistance and high degree of safety in use.

Another object of the present invention is that of providing a modular frame structure for moveable wall made of glass or other pane material assembly thereof being particularly easy.

BRIEF SUMMARY

These and other objects are attained by means of a frame structure according to claim 1.

Advantageous embodiments are an object of the dependent claims.

BRIEF DESCRIPTION OF THE SEVERAL VIEWS OF THE DRAWINGS

For further understanding of the invention and observing the advantages thereof, following is a description of some exemplifying and non-limiting embodiments thereof, with reference to the attached figures, wherein:

FIGS. 21A and 21B are a sectional view, respectively of a hinged door and of a sliding door of the frame according to the invention;

FIGS. 22A and 22B are a sectional view of a hinged door of the frame, respectively, in closed and open configuration;

DETAILED DESCRIPTION

Figure 1:
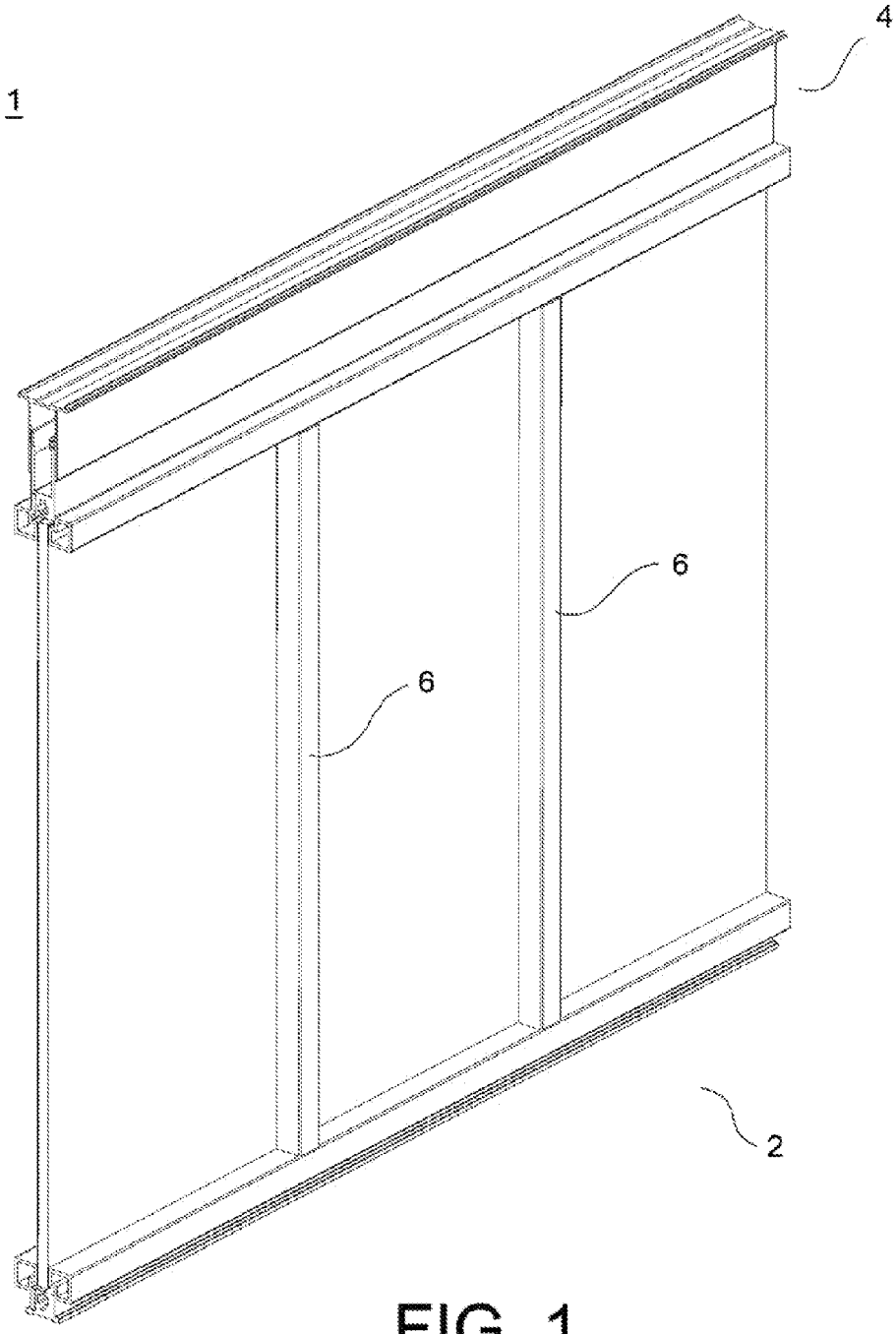
FIG. 1 is a perspective view of a frame structure according to the invention with panes.
Figure 2:
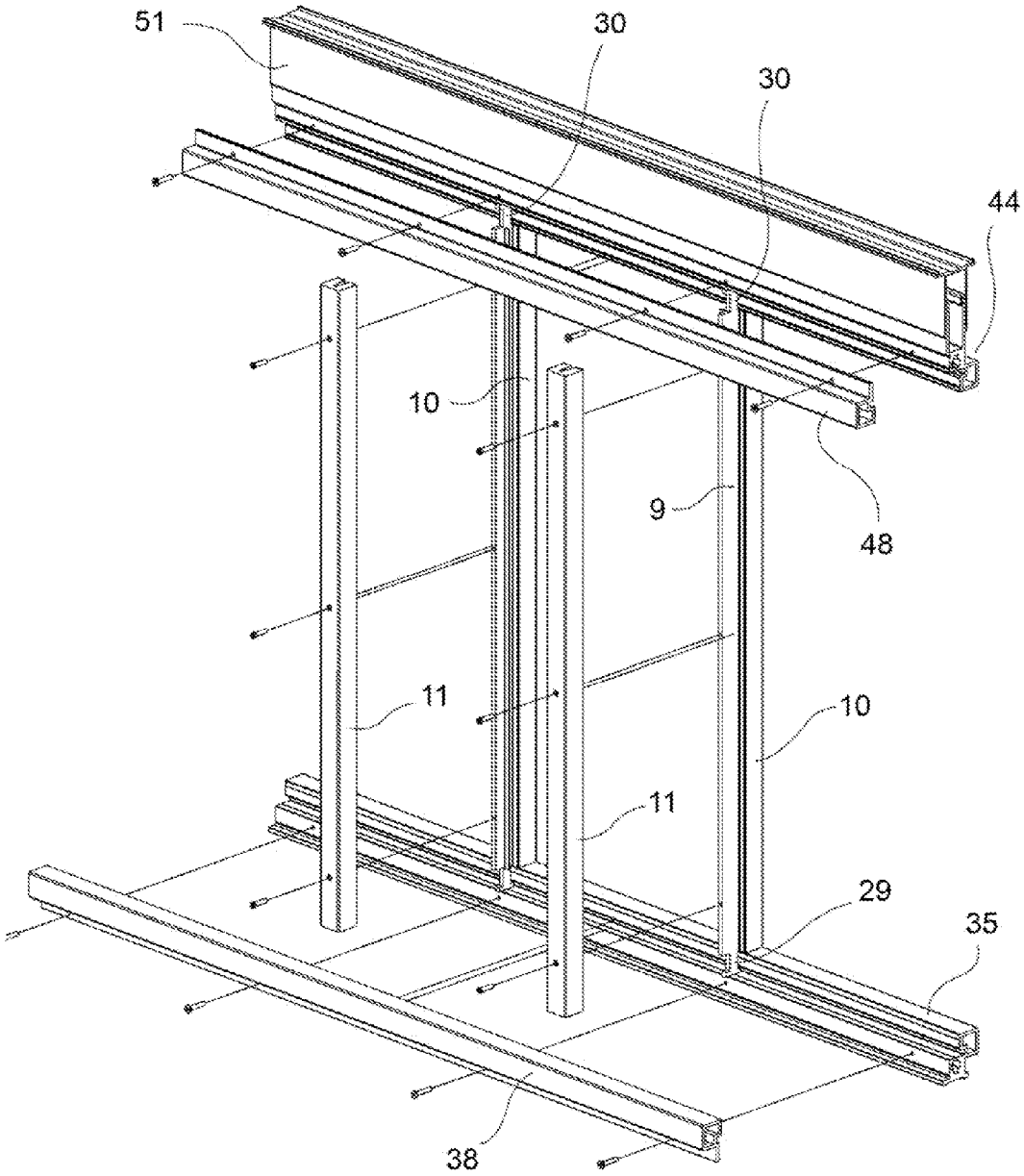
FIG. 2 is an exploded perspective view of a first side of the frame structure according to the invention.
Figure 3:
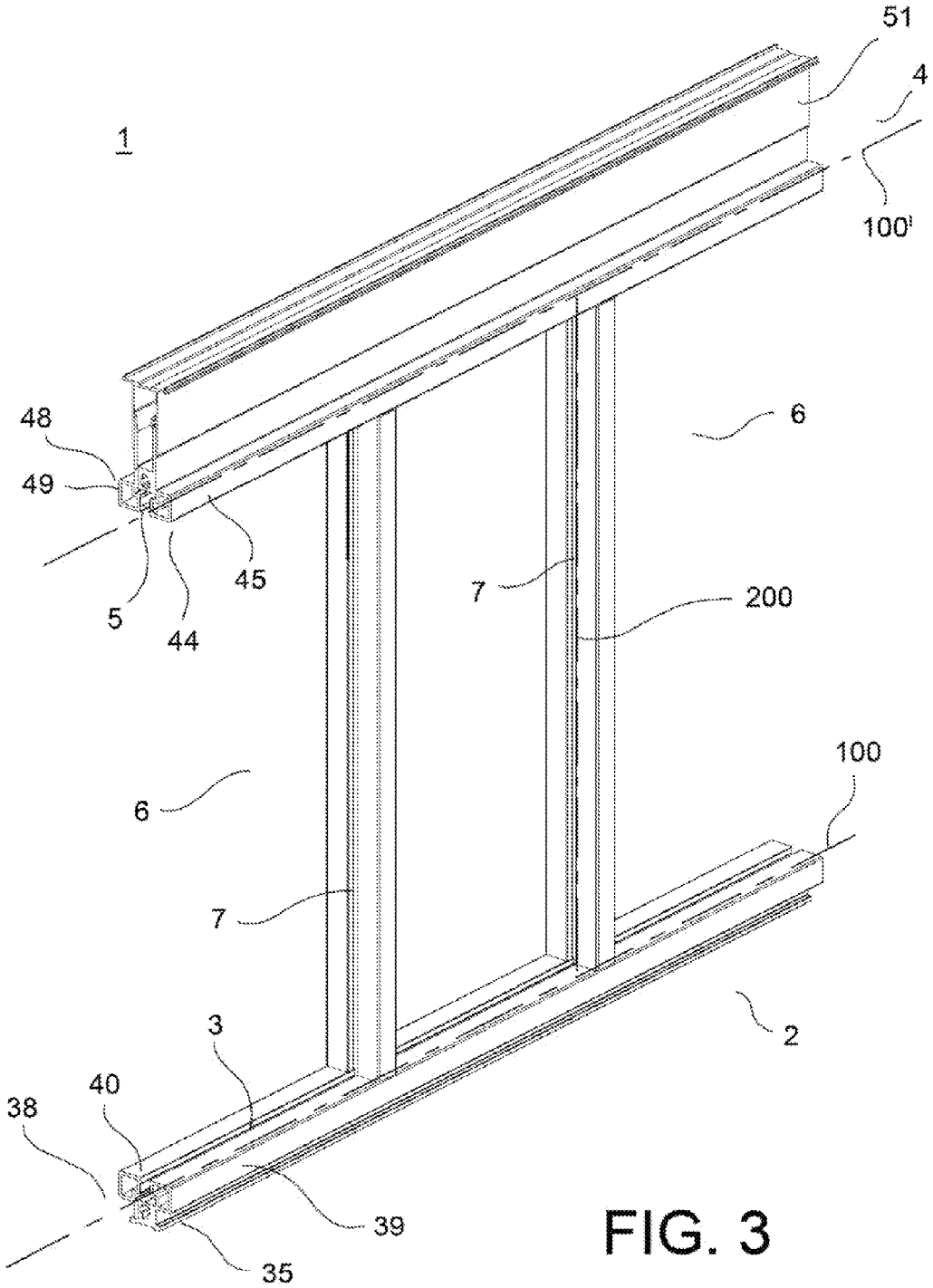
FIG. 3 is a perspective view of a frame structure according to the invention without panes.
Figure 4:
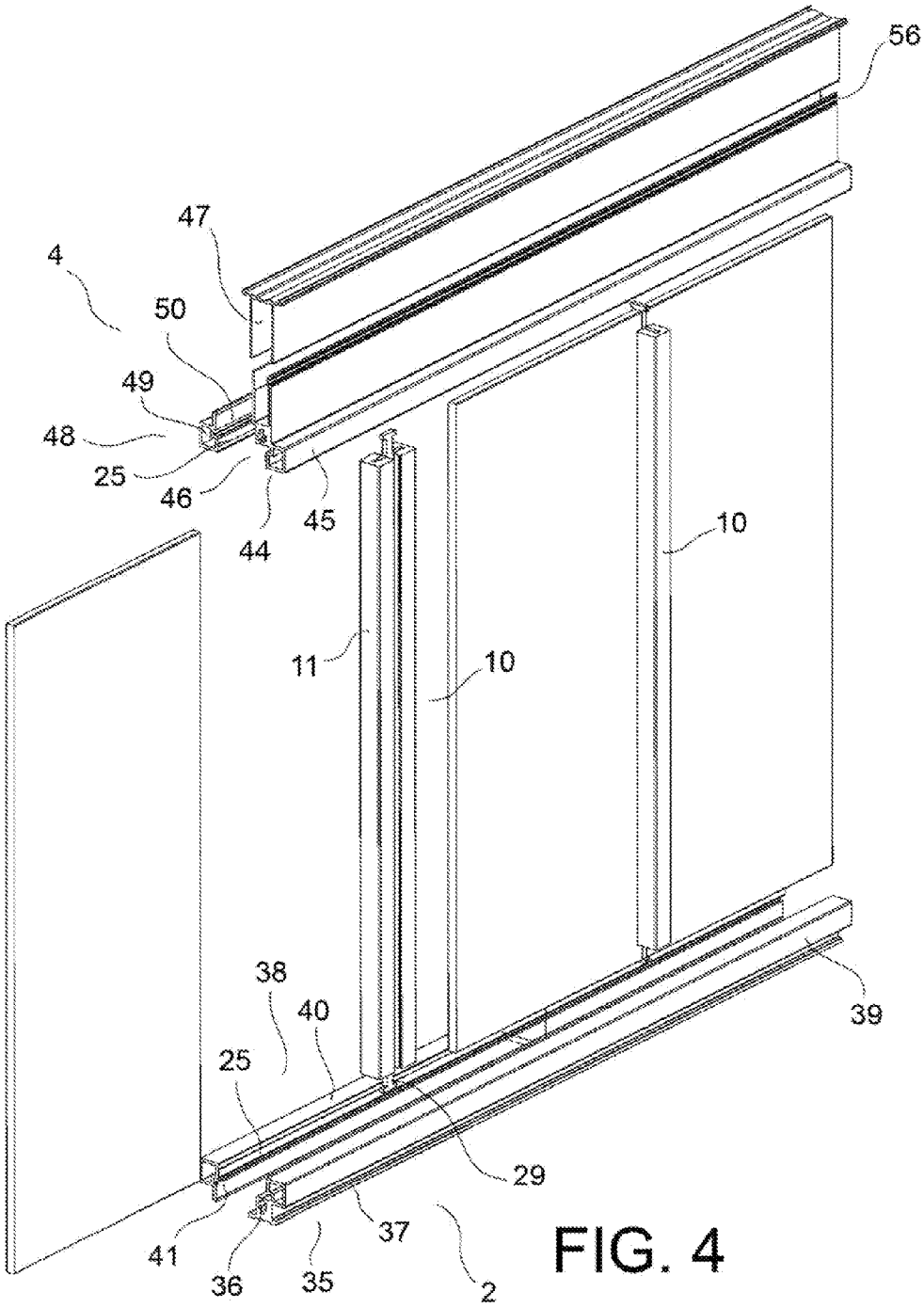
FIG. 4 is an exploded perspective view of a second side of the frame structure according to the invention.
Figure 5:
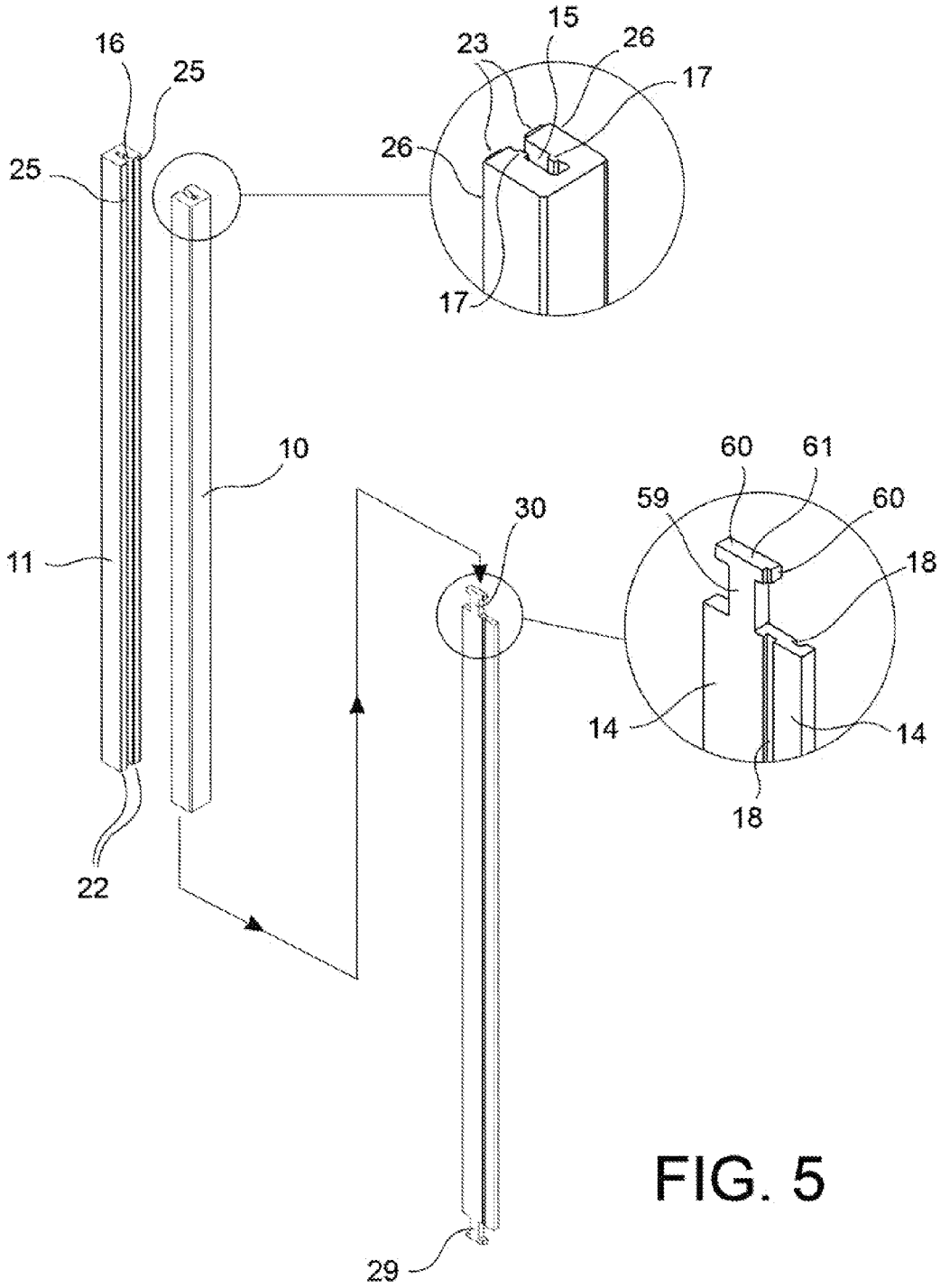
FIG. 5 is a perspective view of a detail of the frame structure according to the invention.

Referring to the figures, a frame structure according to the present invention is generally indicated with reference 1.

The frame 1 comprises a lower side or base 2, with a base pane seat 3 suitable to receive an edge portion of a pane, an upper side or cross member 4, with a cross member seat 5 suitable to receive an edge portion of a pane, as well as one or more posts 6, forming at least one side of the frame 1, with at least one post pane seat 7 suitable to receive a portion of a pane.

The frame 1 further comprises connecting means 8, capable of ensuring a connection between the post 6 and the base 2 and between the post 6 and the cross member 4.

The base 2 is extended along a predefined longitudinal extension 100 which, in a use configuration of the frame 1, is substantially horizontal.

In an embodiment of the invention, the base 2 comprises a primary half-base 35, with a head portion 39, connected in a single piece to a vertically extended trunk 36 suitable to bear the vertical loads and transfer them to the floor by means of feet 37, as well as a secondary half-base 38, with a head portion 40, made in a single piece to a shank 41 made up of a substantially flat wall which is extended vertically.

Advantageously, the secondary half-base 38 is coupled to the primary half-base 35 through a curve-shaped rib 42, obtained at an end of the shank 41 on a side for supporting the shank 41 on the trunk 36, suitable to cooperate with a groove 43, obtained on a side for supporting the trunk 36 on the shank 41, having a shape substantially complementary to the shape of the rib 42, in such a manner to allow correct relative positioning between the secondary half-base 38 and the primary half-base 35 when assembling the base 2.

According to an embodiment, the secondary half-base 38 is fixed to the primary half-base 35 by means of screws. Advantageously, the secondary half-base 38 is connected—by means of screws—to the primary half-base 35 in a portion thereof not visible by a person under the normal conditions of use of the frame. According to an embodiment, the secondary half-base 38 has through holes for screws, obtained on the shank 41, advantageously provided with a recess suitable for accommodating the heads of the screws, positioned at the screw seats obtained on the trunk 36 of the primary half-base 35.

Alternatively, the primary and secondary half-bases 35,38 may be made in a single piece, with a portion of the material serving as a bridge.

The primary and secondary half-bases 35,38 described up to now are advantageously formed by extrusion and configured as hollow sections.

Preferably, such primary and secondary half-bases 35,38 are made of aluminium.

The base pane seat 3 is obtained in the gap interposed between the head portion 39 of the primary half-base 35 and the head portion 40 of the secondary half-base 38, and it is defined by two facing and parallel pane stop surfaces 31.

In an embodiment of the invention, the pane stop surfaces 31 of the base pane seat 3, are defined by cantilevered portions 34 of the half-bases 35,38, overhanging in the direction of the pane.

According to an embodiment of the invention, the connecting means 8 comprise a first undercut coupling seat 27, with at least one undercut 33 obtained on a side facing the pane of a head portion 39,40 of the half-bases 35,38.

According to an embodiment of the invention, the base pane seat 3 is adjacent to the first undercut coupling seat 27, in such a manner that at least one post pane surface 31 of the base pane seat 3 is defined by the undercut 33.

In a particularly advantageous embodiment, the first undercut coupling seat 27 comprises two undercuts 33 in such a manner that each post pane surface 31 of the base pane seat 3 is defined by an undercut 33 on one hand, and by the cantilevered portion 34 of the half-base 35,38 on the other.

According to an embodiment, each post pane surface 31 of the base pane seat 3 is provided with a gasket 25, extended along a larger portion of the post pane surface 31, and having a thickness such that, in a use configuration of the frame 1, i.e. when the primary half-base 35 is fastened onto the secondary half-base 38 and the pane is secured to the frame 1, the main pane surface is in pressing contact with the gasket 25, while the cantilevered portion 34 of the half-bases 35,38 is in proximity to the main pane surface, without contact thereon.

The cross member 4 is extended along a predefined longitudinal extension 100' which, in a use configuration of the frame 1, is substantially parallel and vertically overlying the longitudinal extension 100 of the base 2.

In an embodiment of the invention, for example analogously to the description outlined for the base 2, the cross member 4 comprises a primary semi-cross member 44, as well as a secondary semi-cross member 48. Advantageously, said primary semi-cross member 44 is provided with a head portion 45, connected in a single piece to a trunk 46 suitable to slide telescopically in a compartment 47 formed by the facing and parallel walls of a capsized U-shaped element 51 fixed onto the ceiling through suitable fixing means, for example screws. The secondary semi-cross member 48 is provided with a head portion 49, made in a single piece with a shank 50, made up of a substantially flat wall which is extended vertically.

Advantageously, the trunk 46 of the primary semi-cross member 44 has a primary body 55 from which the two facing and parallel walls 54 depart, shaped in such a manner to cooperate with the walls of the capsized U-shaped element 51 during the sliding of the cross member 4 in the compartment 47.

In a particularly advantageous embodiment, obtained on an end of the wall 54 is a channel 56 suitable to receive a yielding gasket at contact with a wall of the capsized U-shaped element 51, in such a manner to guarantee the acoustic insulation and the recovery of the clearance present between the cross member 4 and the capsized U-shaped element 51.

Advantageously, the secondary semi-cross member 48 is coupled to the primary semi-cross member 44 through a rib 52 having, for example, a curved shape, obtained at an end of the shank 50 on a side for supporting the shank 50 on the trunk 46, suitable to cooperate with a groove 53, obtained on a side for supporting the trunk 46 on the shank 50, having, for example, a shape substantially complementary to the shape of the rib 52, in such a manner to allow correct relative positioning between the secondary semi-cross member 48 and the primary semi-cross member 44 during assembly of the cross member 4.

The secondary semi-cross member 48 is fixed to the primary semi-cross member 44 by means of screws, preferably arranged in portions of the semi-cross members not visible under normal conditions of use of the frame. According to an embodiment, the secondary semi-cross member 48 has through holes for screws, obtained on the shank 50, advantageously provided with a recess suitable for accommodating the heads of the screws, positioned at the screw seats obtained on the trunk 46 of the primary semi-cross member 44.

Alternatively, the primary and secondary semi-cross members 44,48 may be made in a single piece, with a portion of the material serving as a bridge.

The primary and secondary semi-cross members 44,48 described up to now are advantageously formed by extrusion and configured as hollow sections.

Preferably, such primary and secondary semi-cross members 44,48 are made of aluminium.

The cross member seat 5 is obtained in the gap interposed between the head portion 45 of the primary semi-cross member 44 and the head portion 40 of the secondary semi-cross member 48, and it is defined by two facing and parallel pane stop surfaces 32.

In an embodiment of the invention, the pane stop surfaces 32 of the cross member seat 5, are defined by cantilevered portions 57 of the semi-cross members 44,48, overhanging in the direction of the pane.

According to an embodiment of the invention, the connecting means 8 further comprise a second undercut coupling seat 28, with at least one undercut 58 obtained on a side facing the pane of a head portion 45,49 of the semi-cross members 44,48.

According to an embodiment of the invention, the cross member seat 5 is adjacent to the second undercut coupling seat 28, in such a manner that at least one post pane surface 32 of the cross member seat 5 is defined by the undercut 58.

In a particularly advantageous embodiment, the second undercut coupling seat 28 comprises two undercuts 58, in such a manner that each post pane surface 32 of the cross member seat 5 is defined by an undercut 58 on one hand, and by the cantilevered portion 57 of the semi-cross member 44,48 on the other.

According to an embodiment, each post pane surface 32 of the cross member seat 5 is provided with a gasket 25, extended along a larger portion of the post pane surface 32, and having a thickness such that, in a use configuration of the frame 1, i.e. when the primary semi-cross member 44 is fastened to the secondary semi-cross member 48 and the pane is secured to the frame 1, the main pane surface is in pressing contact with the gasket 25, while the cantilevered portion 57 of the semi-cross members 44,48 is in proximity to the main pane surface, without contact thereon.

In a use configuration of the frame 1, the post 6 is extended along a longitudinal axis 200 substantially perpendicular to the longitudinal extensions 100, 100' of the base 2 and of the cross member 4.

According to an aspect of the present invention, the post 6 comprises a reinforcing bar 9 suitable to confer stiffness to the frame 1.

Advantageously, such reinforcing bar 9 is configured as a flat bar, having an extended upright section, preferably rectangular, preferably with the long side of the section arranged transversely with respect to the longitudinal extensions 100, 100' of the base 2 and of the cross member 4.

Preferably, the reinforcing bar 9 is made of resistant metal material, for example iron or steel.

In an embodiment of the invention, the connecting means 8 further comprise a first and second coupling portion 29,30 of the post 6. Advantageously, such coupling portion 29,30 of the post 6 is suitable to cooperate with the connecting means 8 provided for in any of the embodiments of the aforedescribed base 2 and, advantageously, but not necessarily, cross member 4.

Advantageously, such coupling portions 29,30 are obtained as end portions of the reinforcing bar 9.

According to an aspect of the present invention, the first coupling portion 29 is insertable into the first undercut coupling seat 27 in any point of the longitudinal extension 100 of the base 2.

Analogously, the second coupling portion 30 is insertable into the second undercut coupling seat 28 in any point of the longitudinal extension 100' of the cross member 4.

Such first and second coupling portions 29,30 may be selectively coupled in a release position, in which they do not engage, respectively, the first and second undercut coupling seat 27, 28, and in an engaging position in which they engage, respectively, the first and second undercut coupling seat 27, 28.

Advantageously, such first and second coupling portions 29, 30 may pass from the release position to the engaging position and from the engaging position to the release position, through a rotation of said post 6 around longitudinal axis 200 thereof.

In an embodiment of the invention, the coupling portion 29,30 comprises a neck 59 which is extended along the longitudinal axis 200 of the post 6, connected, for example, in a single piece with a central portion of the reinforcing bar 9 on one hand, and with an end portion 61 on the other, such end portion 61 bearing at least one projection 60, overhanging in a direction substantially transverse to the neck 59, which—in the engaging configuration—is extended into the at least one undercut 33,58 of the first and second undercut coupling portion 27,28.

Advantageously, the neck 59 has an upright section with maximum transverse overall dimension (i.e. the overall dimension in a direction transverse to the longitudinal axis 200 of the post 6) smaller than the distance between the cantilevered portions 34,57, respectively, of the half-bases 35,38 and of the semi-cross members 44,48.

Advantageously, the end portion 61 of the coupling portions 29,30 has an upright section with maximum transverse overall dimension (i.e. the overall dimension in a direction transverse to the longitudinal axis 200 of the post 6) smaller than the width of the first and second undercut coupling seat 27,28.

Therefore, the coupling portions 29,30 are coupled with clearance to the undercut coupling seats 27,28.

In a particularly advantageous embodiment, the coupling portions 29,30 are T-shaped and have two projections 60, overhanging in a direction transverse to the neck 59, suitable to engage, in the engaging position, the undercuts 33,58 of the first and second undercut coupling portions 27,28.

According to an embodiment, the post 6 comprises a first and a second half-post 10,11, extended along the longitudinal axis 200 of the post 6, respectively, with a first and second concavity 12,13, obtained centrally on a side of the half-posts 10,11 facing the pane, suitable to receive a side portion 14 of the reinforcing bar 9.

Each of such concavities 12,13 is partly defined by guide surfaces 15,16 facing and configured to guide the side portions 14 of the reinforcing bar 9 in the concavity 12,13 when assembling the half-posts 10,11 to the reinforcing bar 9.

Obtained on the side of the half-posts 10,11 facing the pane are two pane stop surfaces 22 of the first half-post 10, and two pane stop surfaces 23 of the second half-post 11. The pane stop surfaces 22 of the first half-post 10 are defined on one hand by the first concavity 12, on the other by cantilevered portions 26, overhanging from the pane stop surfaces 22 in the direction of the pane. Analogously, the pane stop surfaces 23 of the second half-post 11 are defined on one hand by the second concavity 13, on the other by cantilevered portions 26, overhanging from the pane stop surfaces 23 in the direction of the pane.

According to an embodiment, the first half-post 10 is coupled to the reinforcing bar 9 through a shape coupling.

Advantageously, such shape-coupling comprises a track 17 overhanging from a guide surface 15 of the concavity 12 of the first half-post 10 suitable to be inserted into a groove 18 obtained on a side portion 14 of the reinforcing bar 9.

In a preferred embodiment, such shape-coupling comprises two tracks 17, each obtained on each guide surface 15, advantageously at a misaligned position in such a manner to guarantee the correct coupling direction, suitable to be inserted in an equal number of grooves 18 obtained on a side portion 14 of the reinforcing bar 9.

Alternatively, the first half-post 10 may be connected interfering with the reinforcing bar 9 or, for example, through welding, or still made in a single piece with the reinforcing bar 9.

According to an embodiment, the second half-post 11 has cantilevered notches 19, overhanging from the guide surfaces 16, serving as stop elements for the side portion 14 in the second concavity 13.

In an embodiment of the invention, the second half-post 11 is configured to be fixed to the reinforcing bar 9 by means of screws. For such purpose, the second half-post 11 has on a side opposite to the side facing the pane, through holes 24 for screws, with a recess suitable for accommodating the heads of the screws, positioned at the screw seats obtained on the side portion 14 of the reinforcing bar 9.

Advantageously, the coupling portions 29,30 of the post 6 are extended in a direction of the longitudinal axis 200 of the post 6 beyond the half-posts 10,11 in such a manner that, when the post 6 is assembled to the base 2 and to the cross member 4, the half-posts 10,11 abut against the head portions 39,40 of the half-bases 35,38 and with the head portions 45,49 of the semi-cross members 44,48, while the coupling portions 29,30 are coupled with clearance to the undercut coupling seats 27,28 of the base 2 and of the cross member 4.

The half-posts 10,11 described up to now are advantageously formed by extrusion and, for example, configured as solid beams.

Preferably, such half-posts 10,11 are made of aluminium.

In an assembled configuration of the post 6, i.e. when the two half-posts 10,11 are coupled to the reinforcing bar 9, the post 6 comprises two post pane seats 7, each defined by a post pane surface 22 of the first half-post 10 and by a post pane surface 23 of the second half-post 11, in such a manner that the pane stop surfaces 22,23 of each post pane seat 7 are facing and parallel.

Each post pane surface 22,23 of the post pane seat 7 is provided with a gasket 25, extended along a larger portion of the post pane surface 22,23, and having a thickness such that, in a use configuration of the frame 1, i.e. when the second half-post 11 is fastened onto the first half-post 10 and the pane is secured to the frame 1, the main pane surface is in pressing contact with the gasket 25, while the cantilevered portion 26 of the half-posts 10,11 is in proximity to the main pane surface, without contact thereon.

Figure 6:
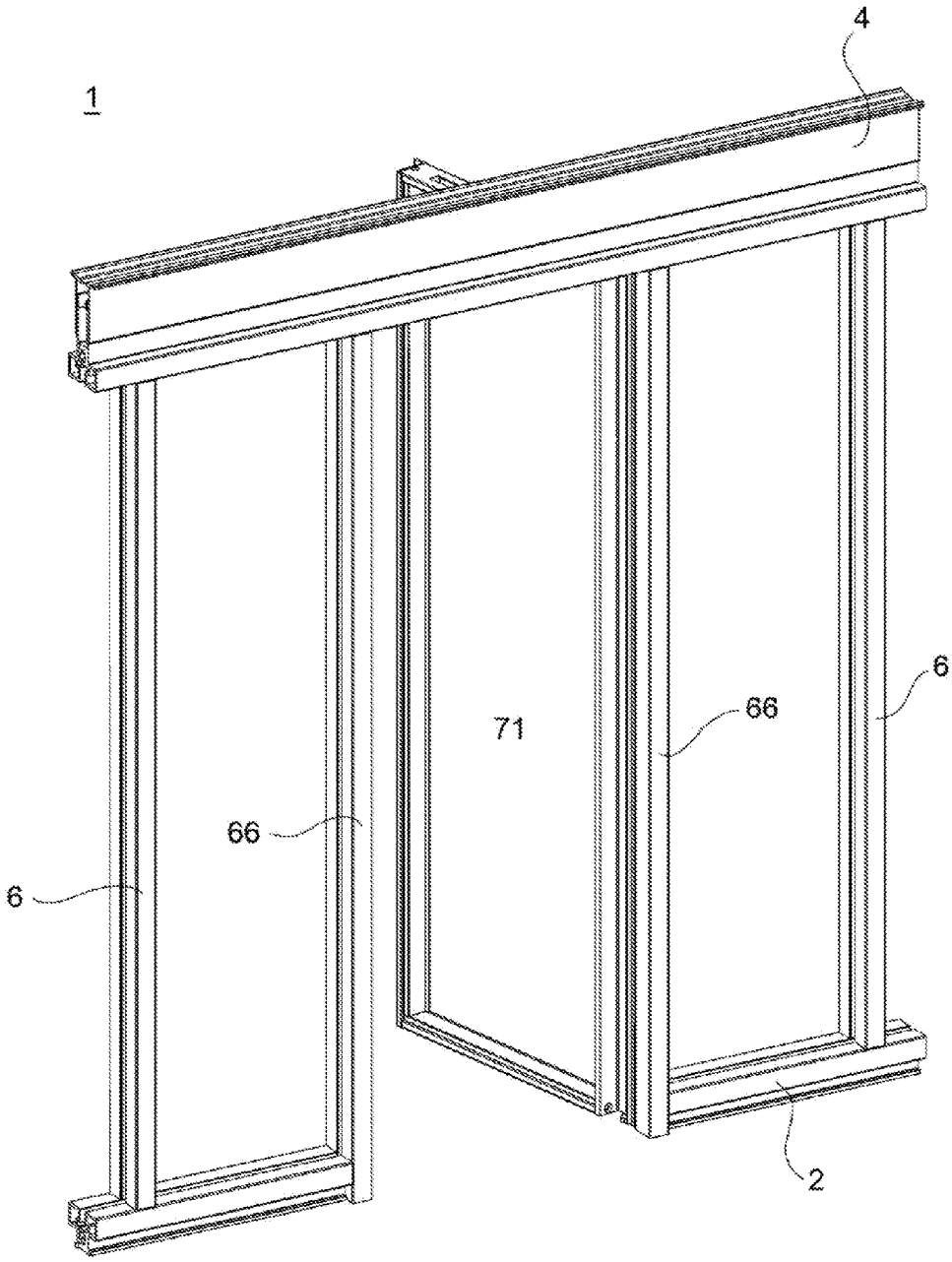
FIG. 6 is a perspective view of a first side of the frame according to the invention with a hinged door at open position.
Figure 7:
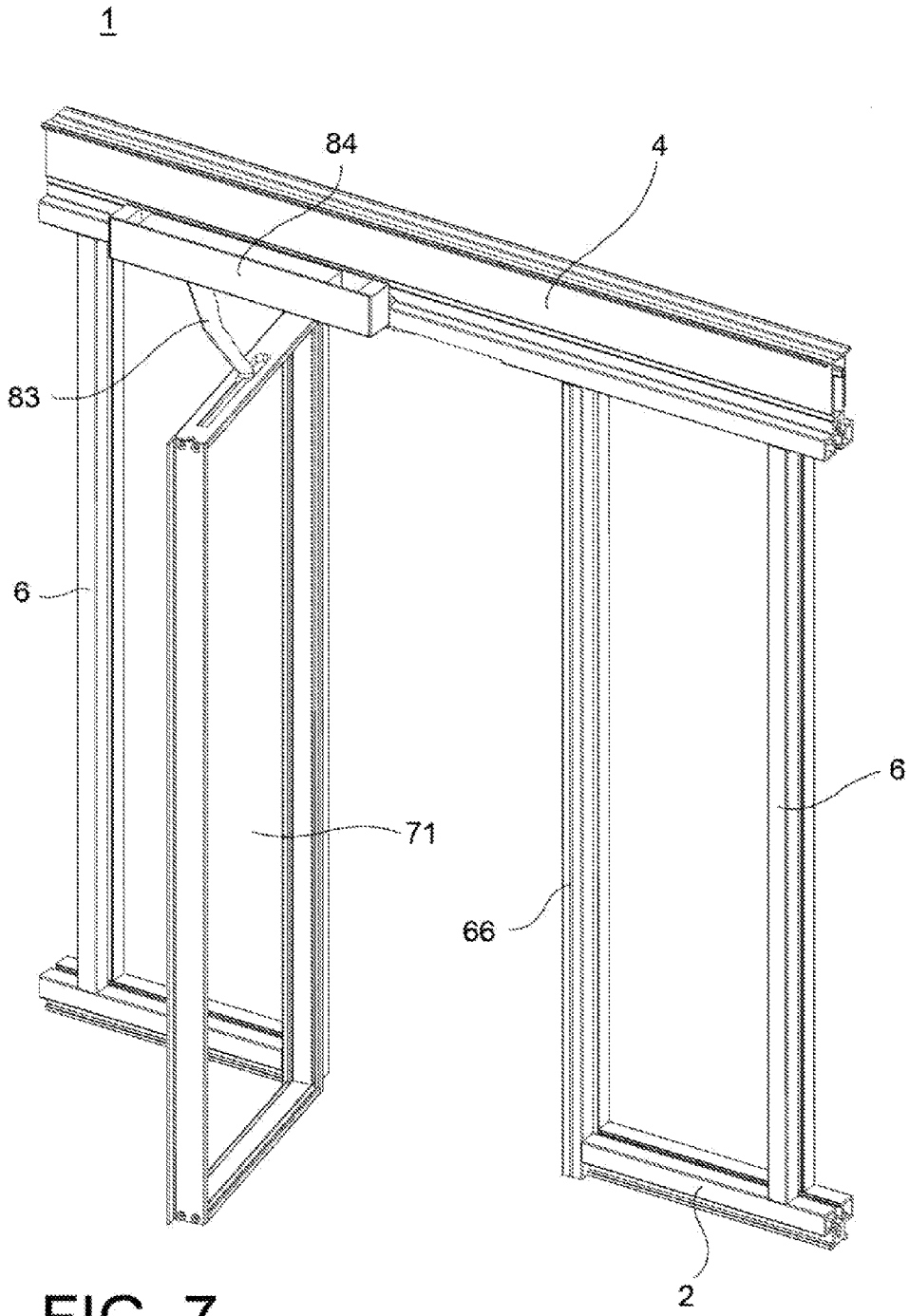
FIG. 7 is a perspective view of a second side of the frame of FIG. 6.
Figure 8:
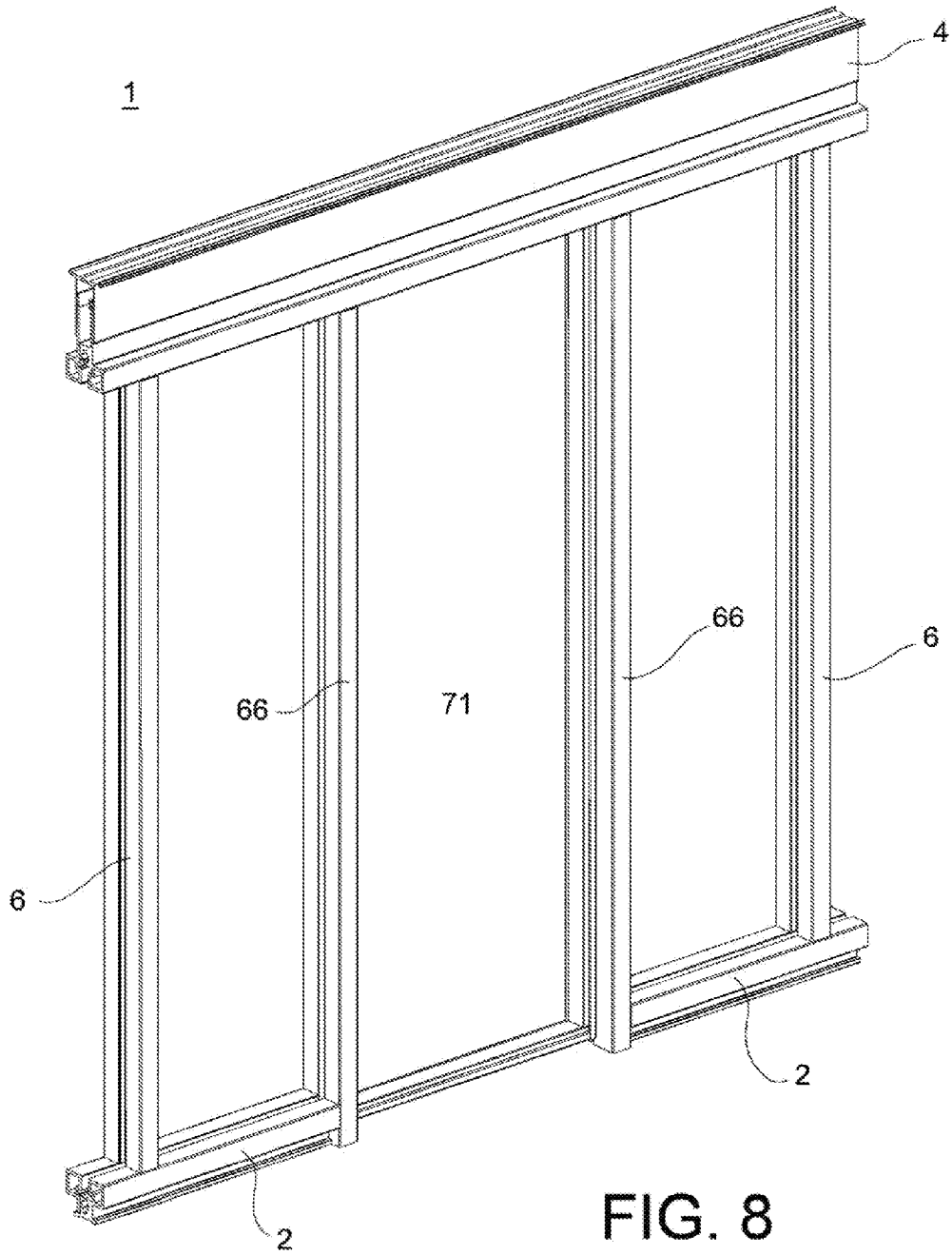
FIG. 8 is a perspective view of the frame of FIG. 6 with hinged door at the closed position.
Figure 9:
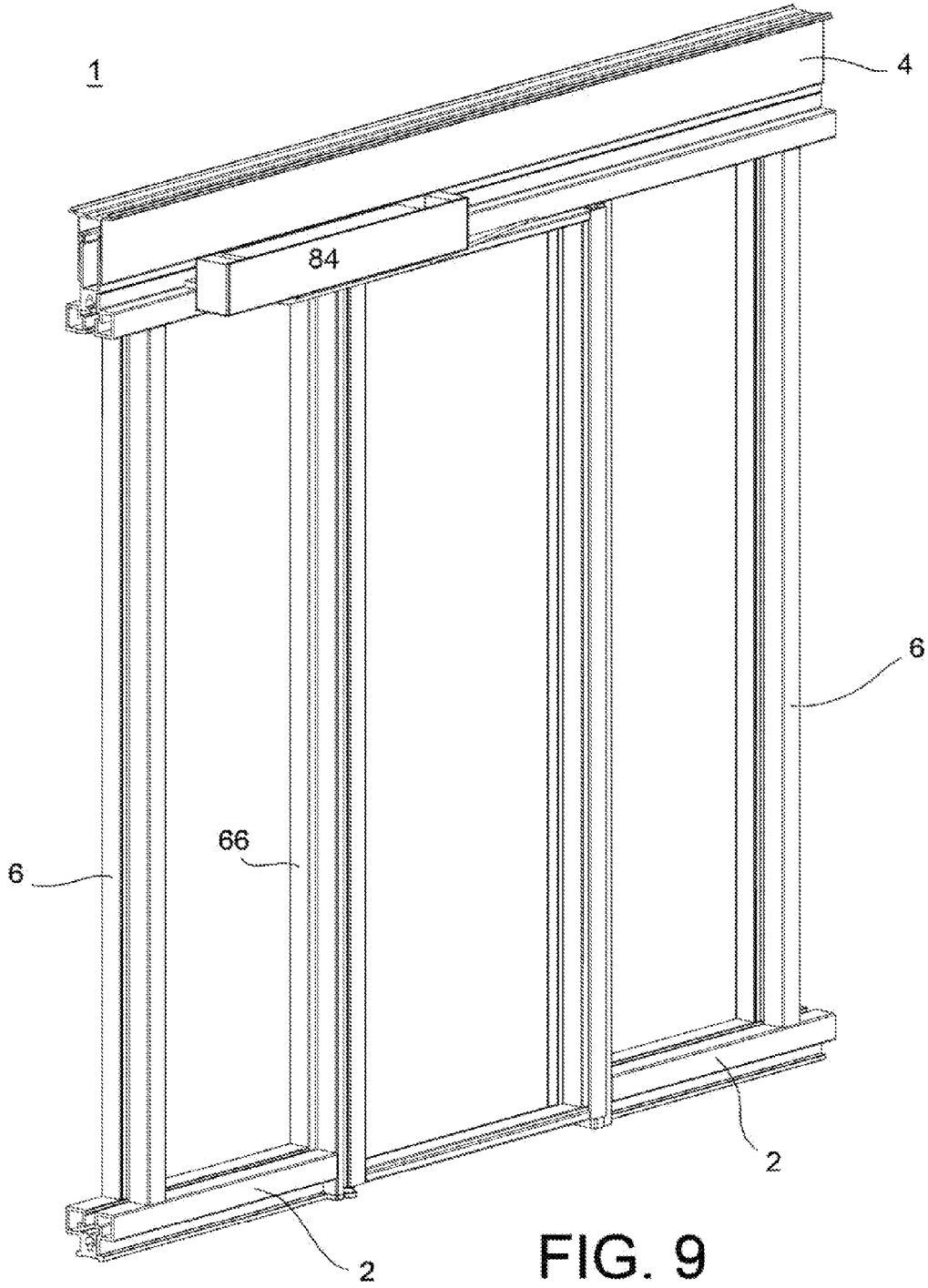
FIG. 9 is a perspective view of a second side of the frame of FIG. 8.
Figures 10A, 10B, 10C, 10D:
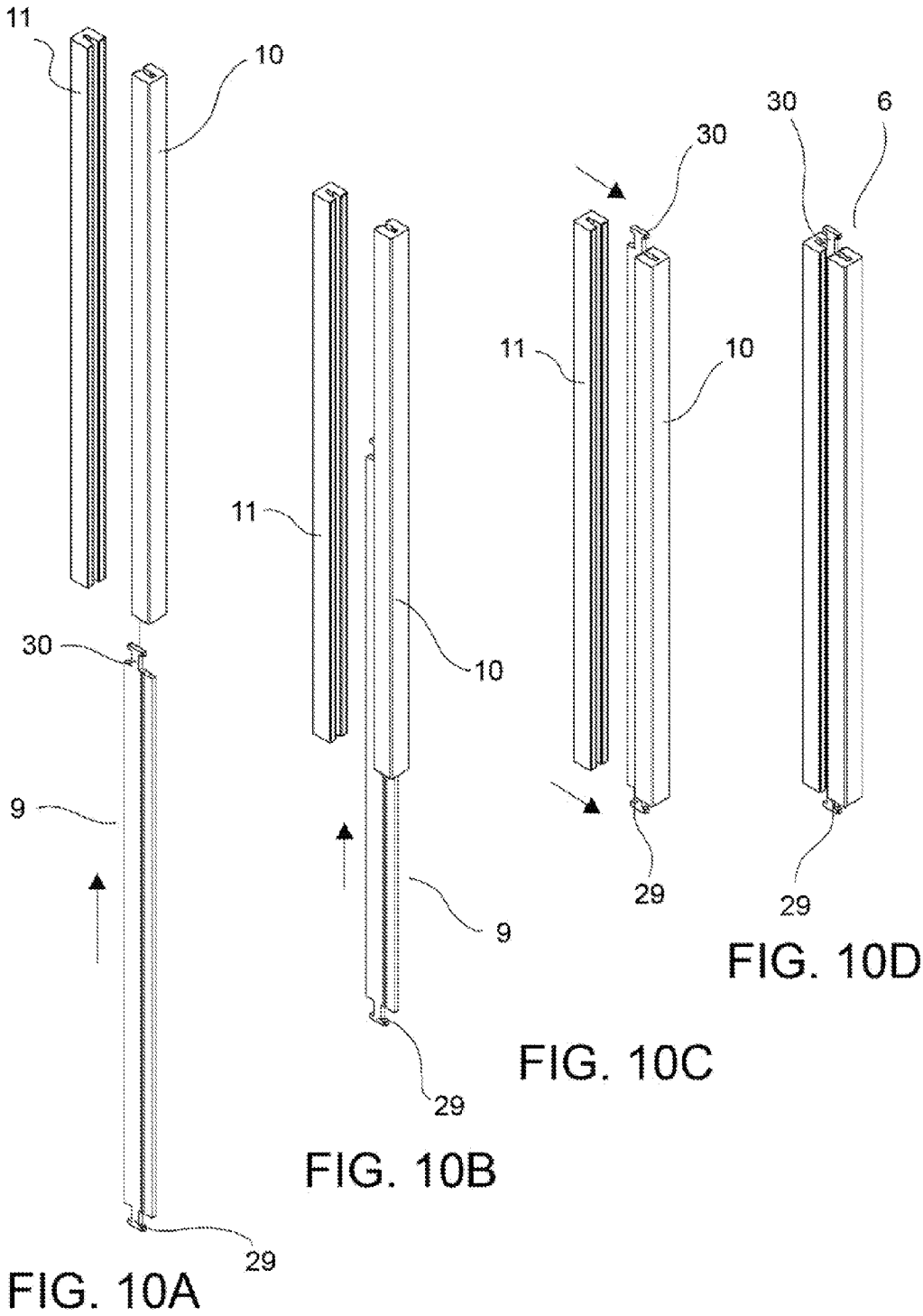
FIGS. 10A, 10B, 10C, 10D are a perspective view of an assembly sequence of a post of the frame according to the invention.
Figure 11:
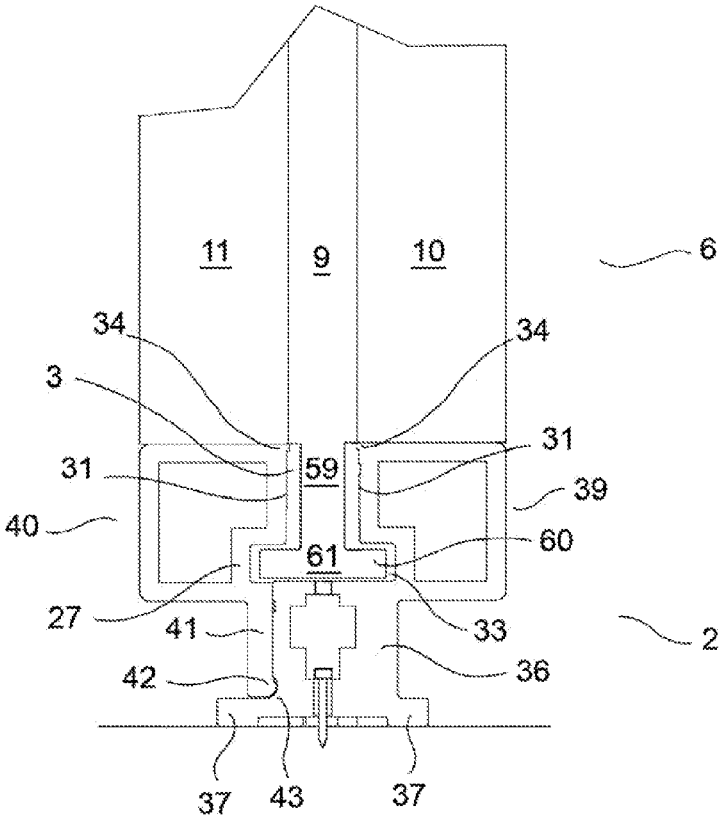
FIG. 11 is a side view of a detail of the frame structure according to the invention in a first configuration.
Figure 12:
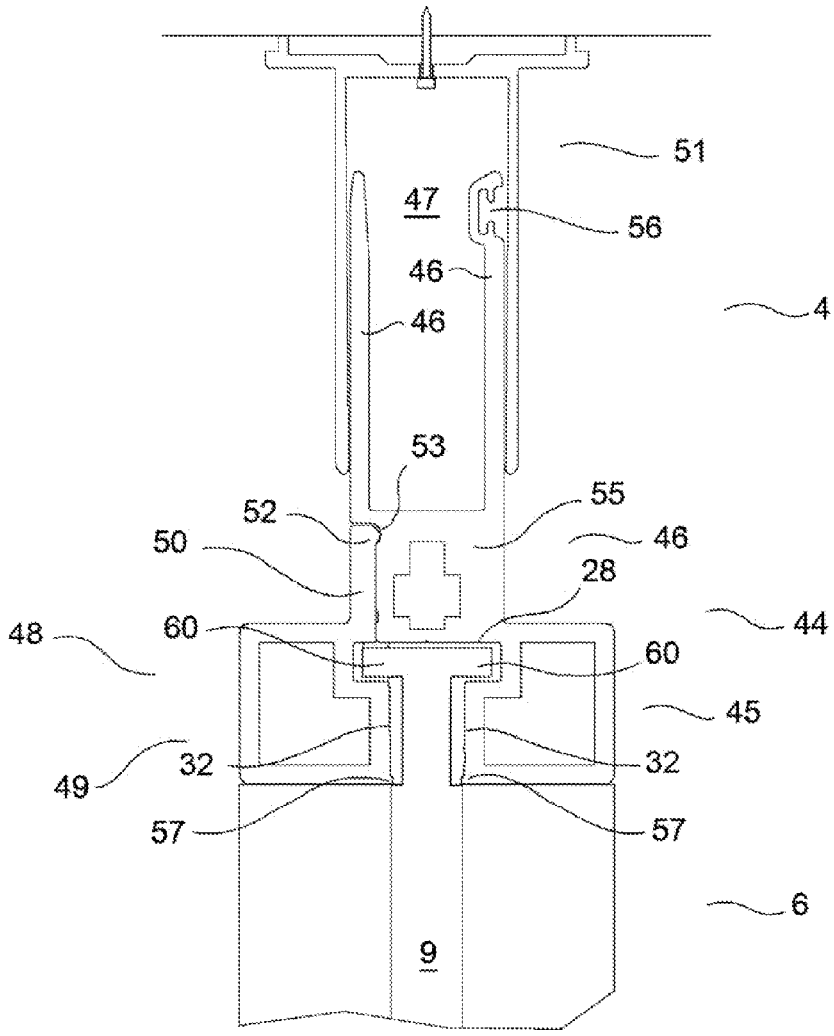
FIG. 12 is a side view of a further detail of the frame structure according to the invention in a first configuration.
Figure 13:
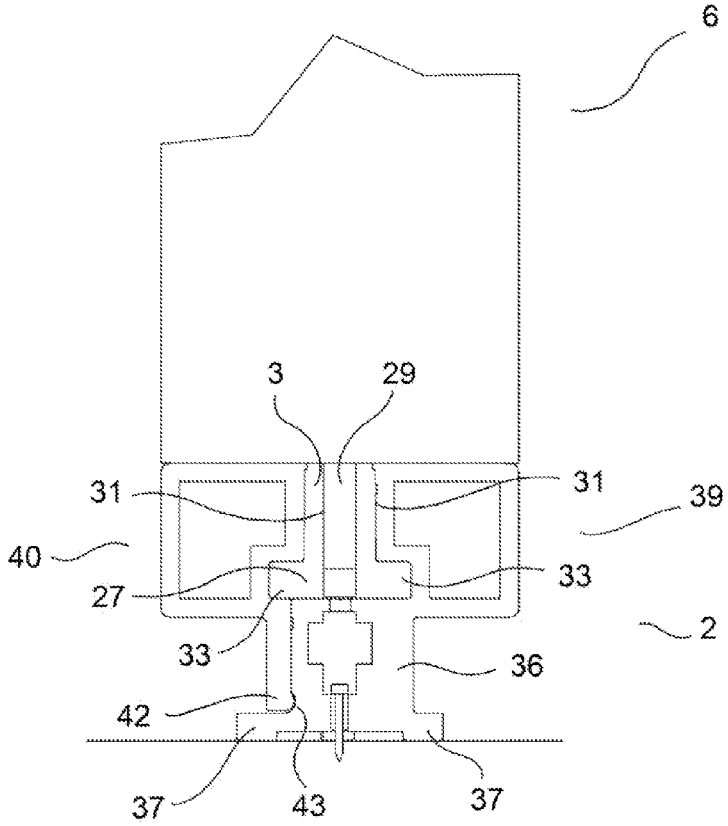
FIG. 13 is a side view of the detail of FIG. 11 in a second configuration.
Figure 14:
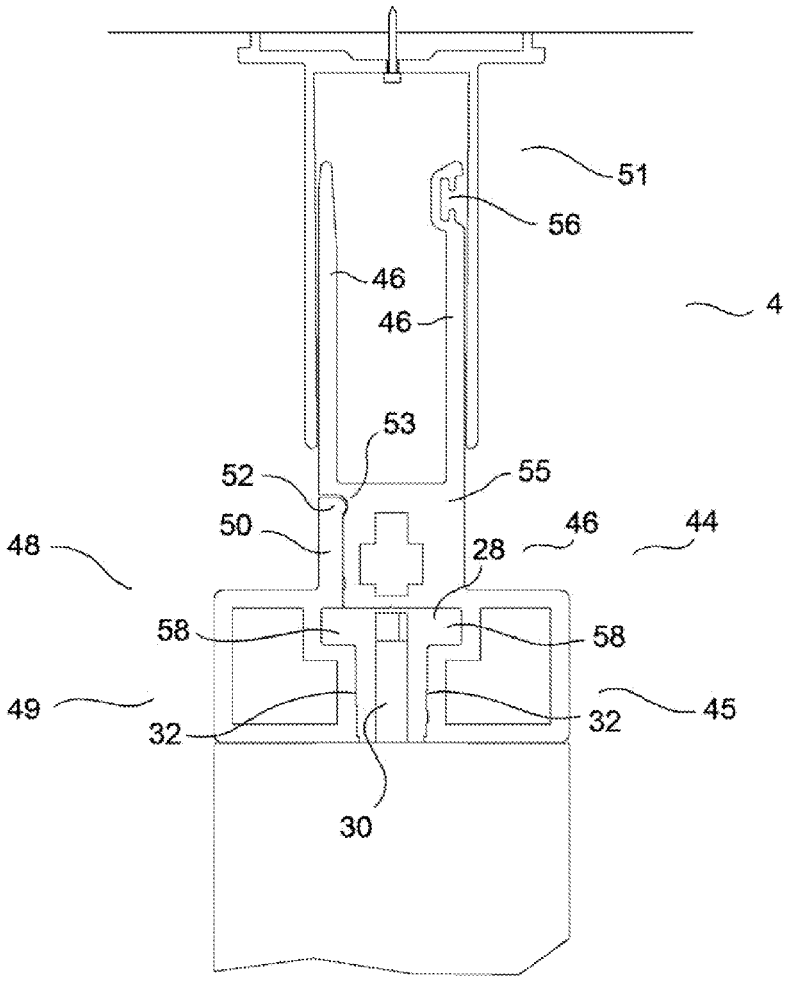
FIG. 14 is a side view of the detail of FIG. 12 in a second configuration.
Figure 15:
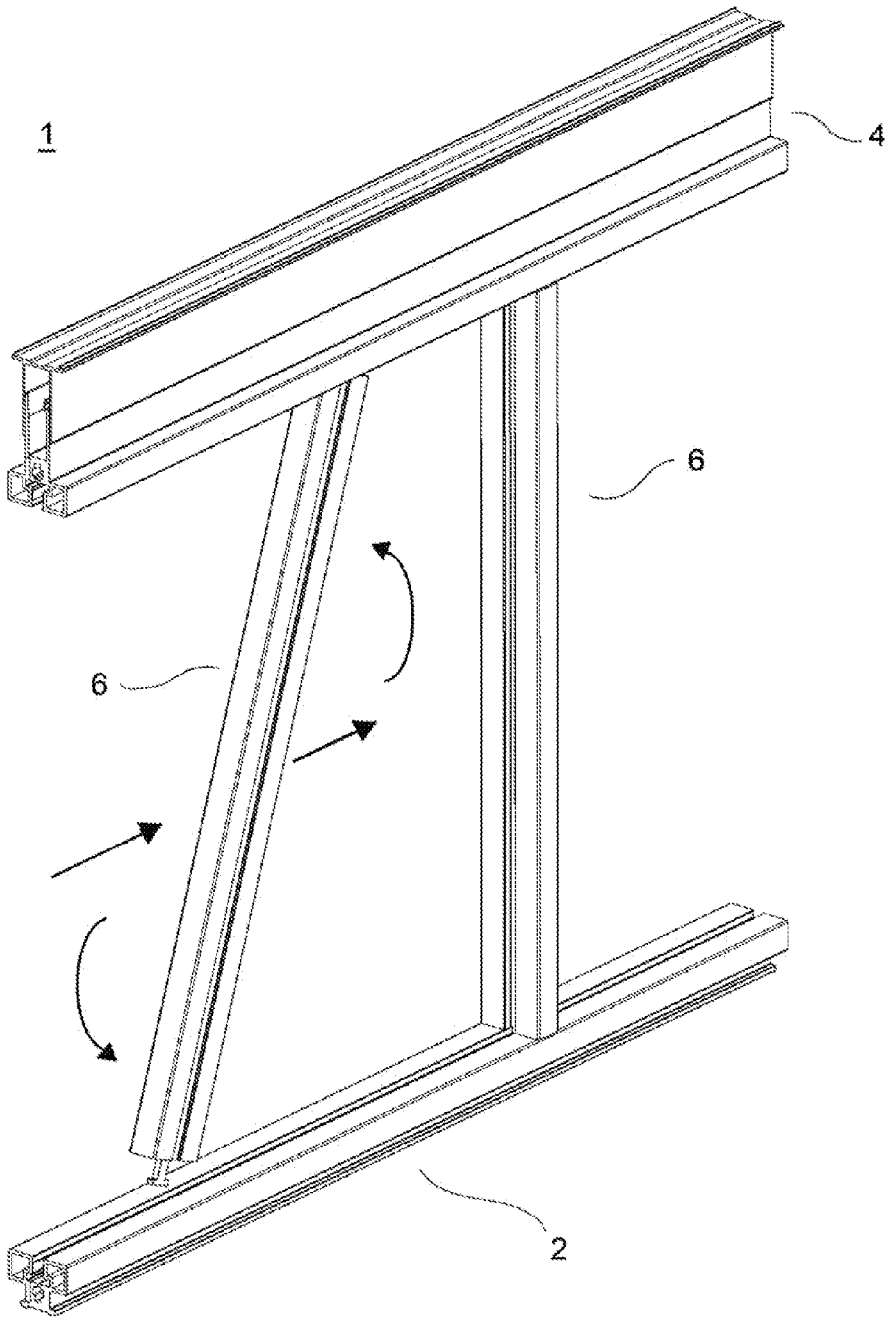
FIGS. 15, 16, 17 are a perspective view of a frame according to the invention in various assembly configurations.
Figure 16:
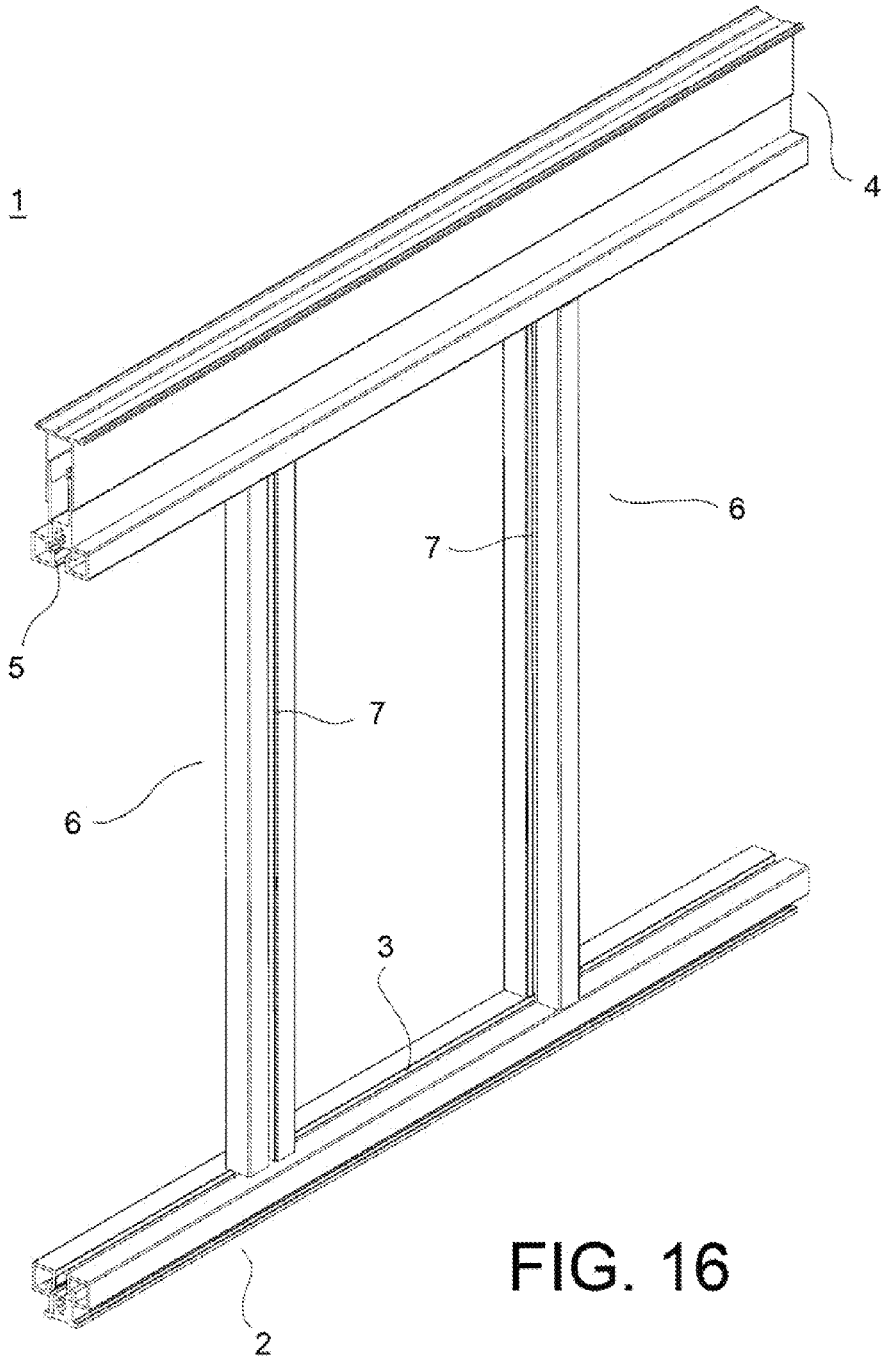
Figure 17:
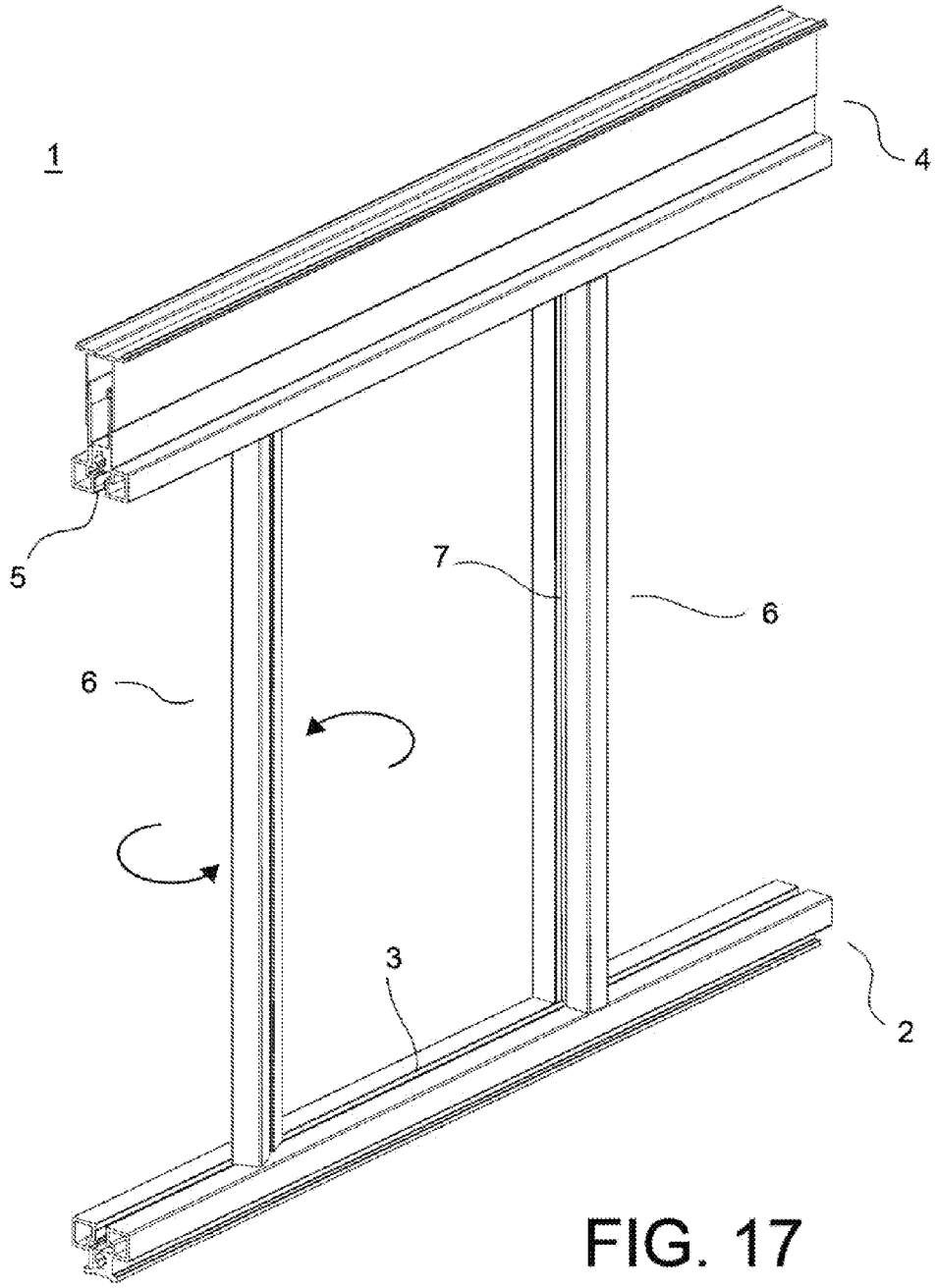
Figure 18:
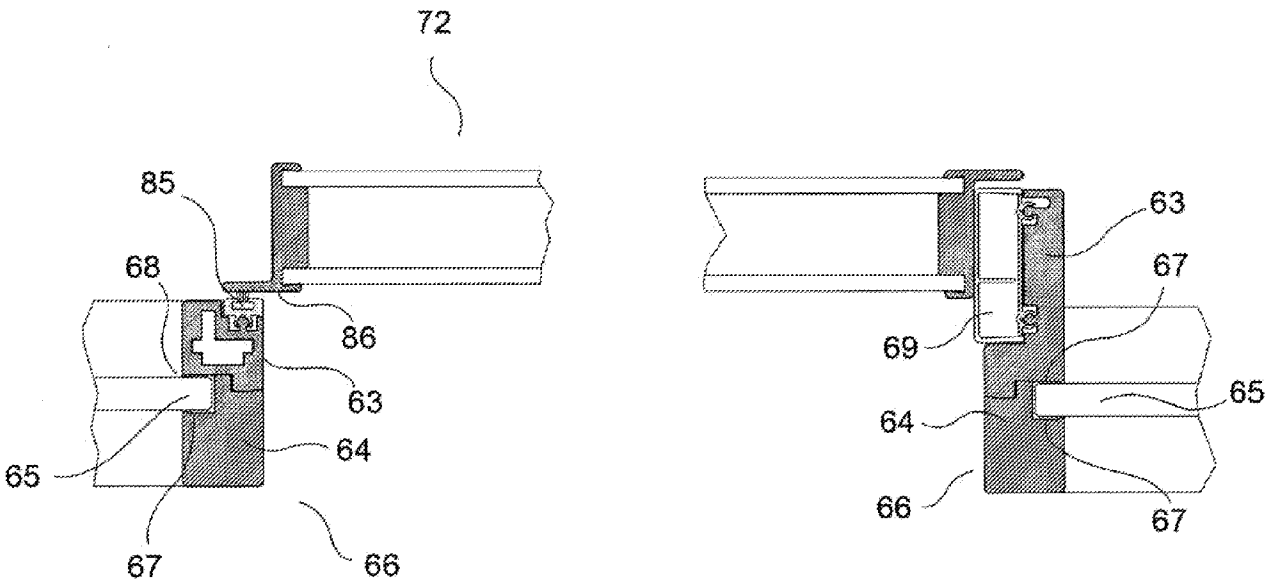
FIG. 18 is a sectional view of a sliding door of the frame according to the invention.
Figure 19:
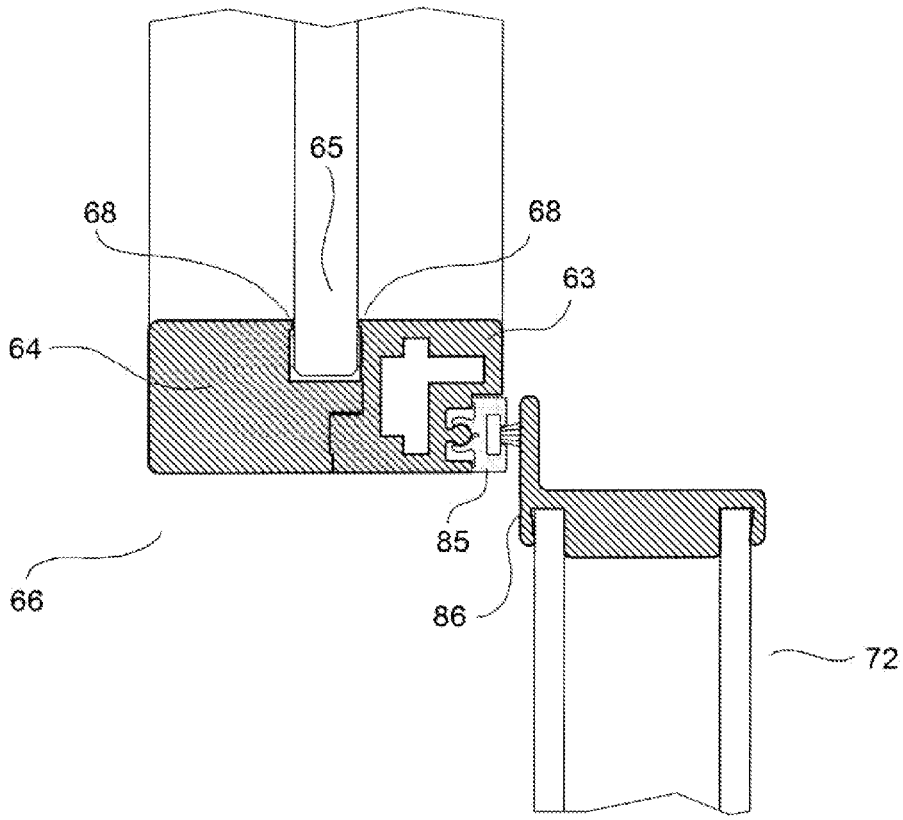
FIG. 19 is an enlarged view of a detail of FIG. 18.
Figure 20:
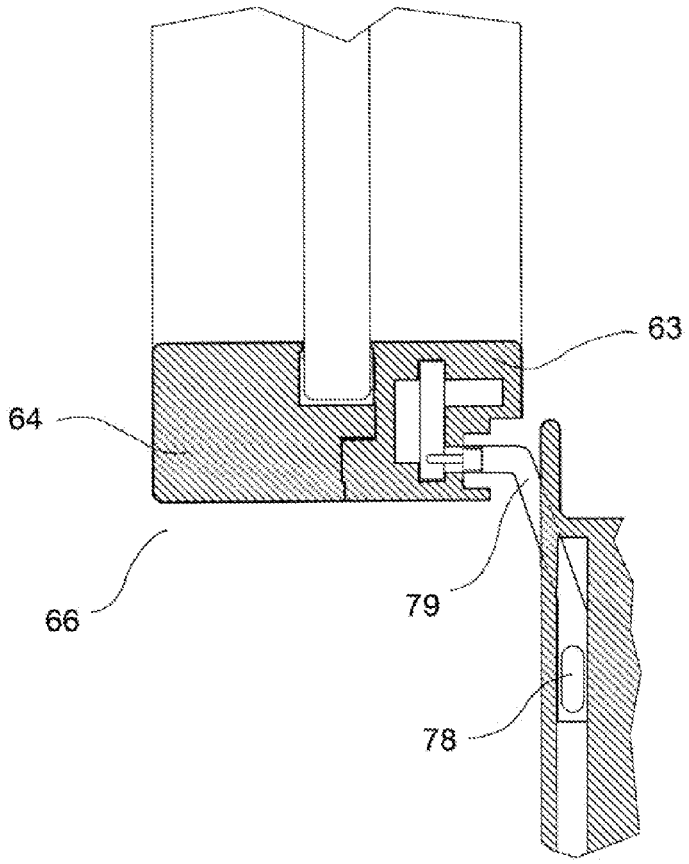
FIG. 20 is an enlarged view of a further detail of the door of the frame of FIG. 18.
Figure 23:
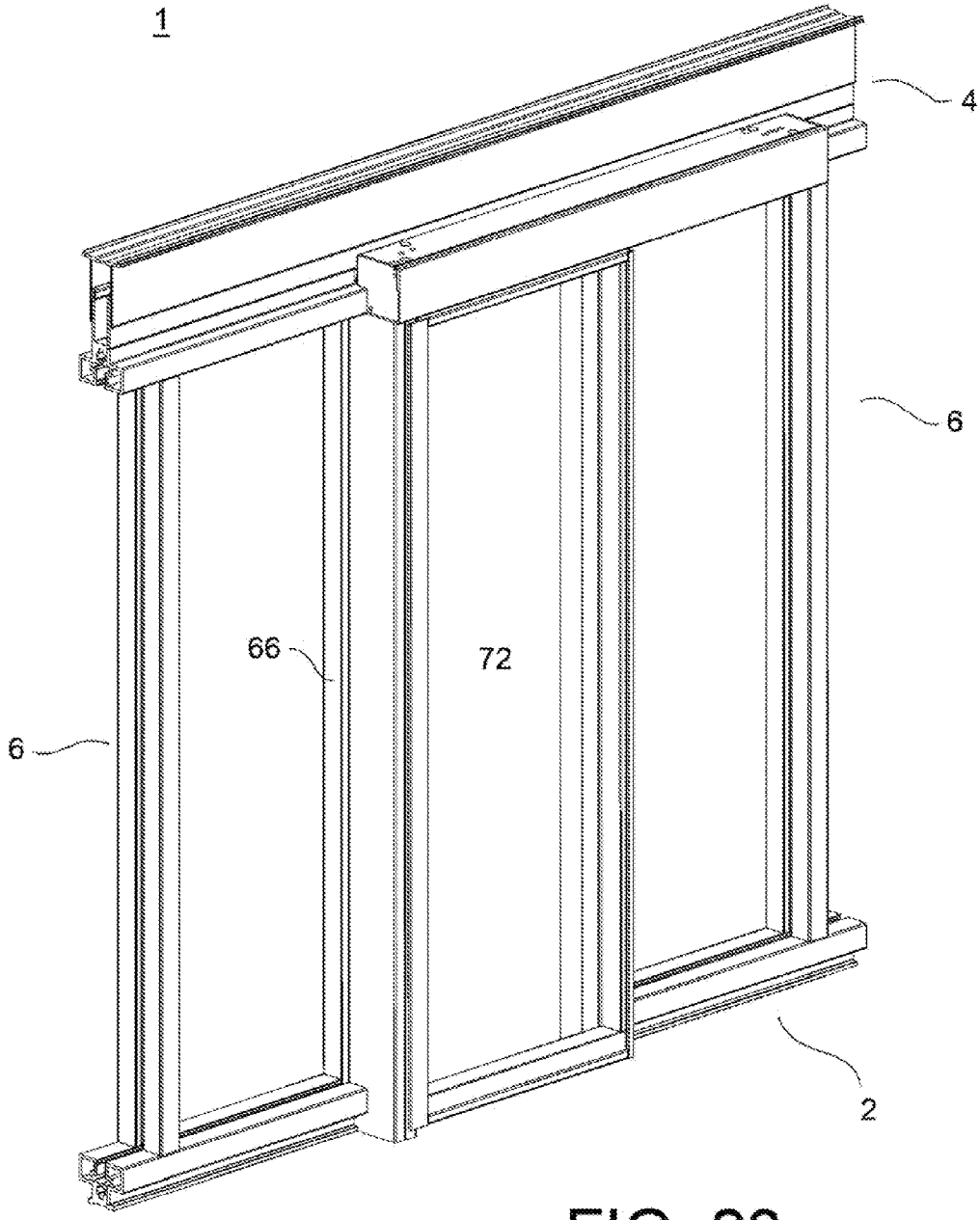
FIG. 23 is a perspective view of a first side of the frame according to the invention with a sliding door at the closed position.
Figure 24:
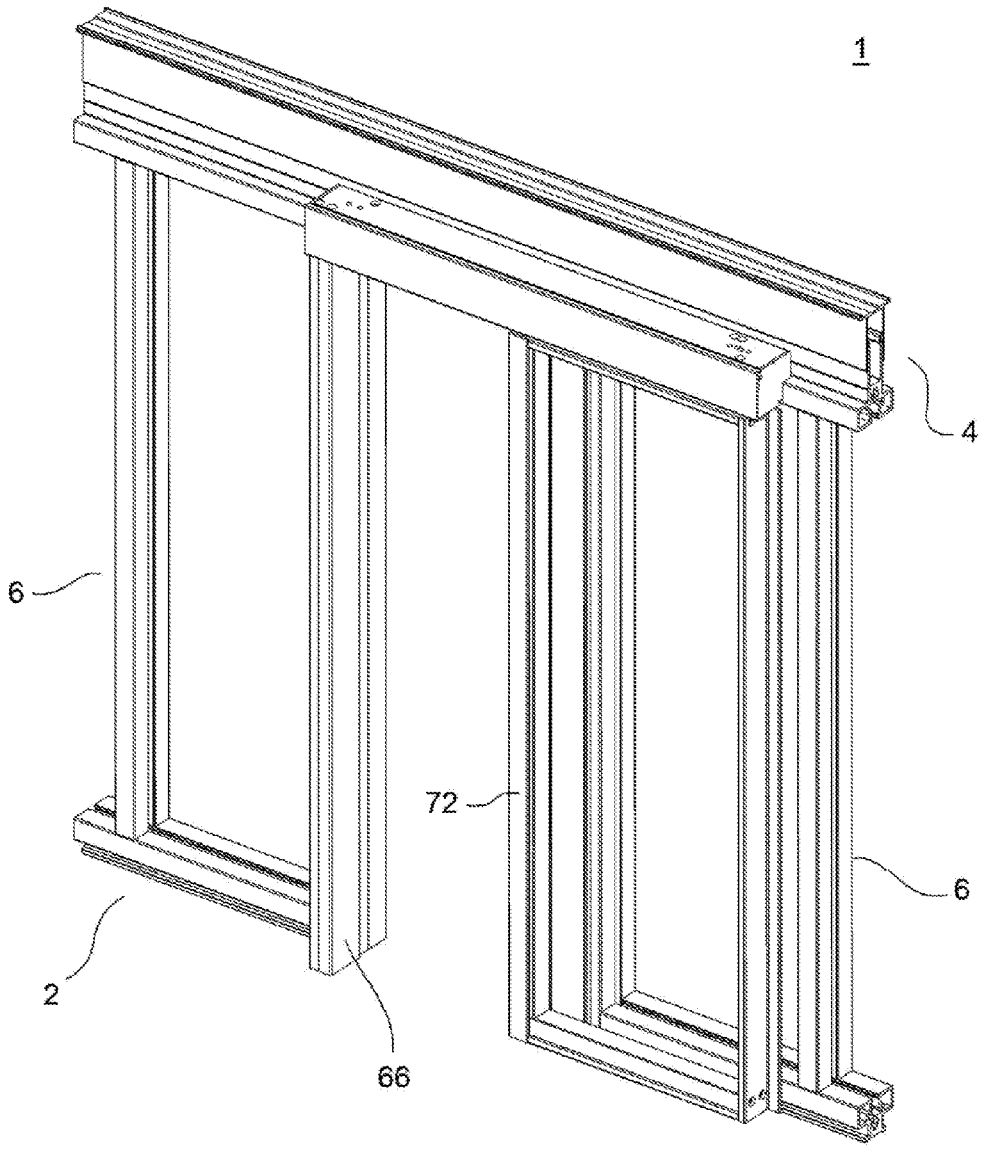
FIG. 24 is a perspective view of the frame of FIG. 23 with sliding door at open position.
Figure 25:
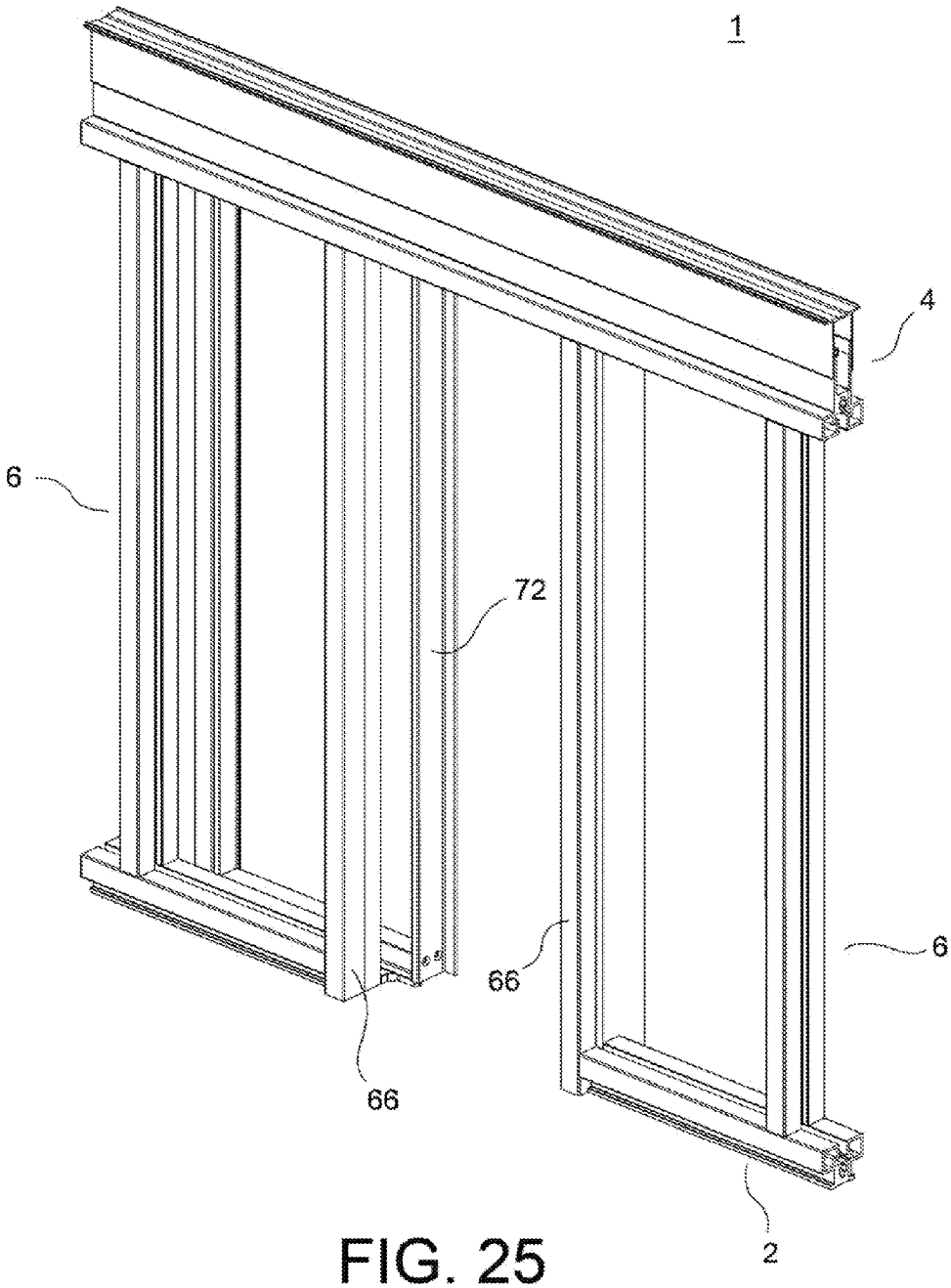
FIG. 25 is a perspective view of a second side of the frame of FIG. 24.
Figure 26:
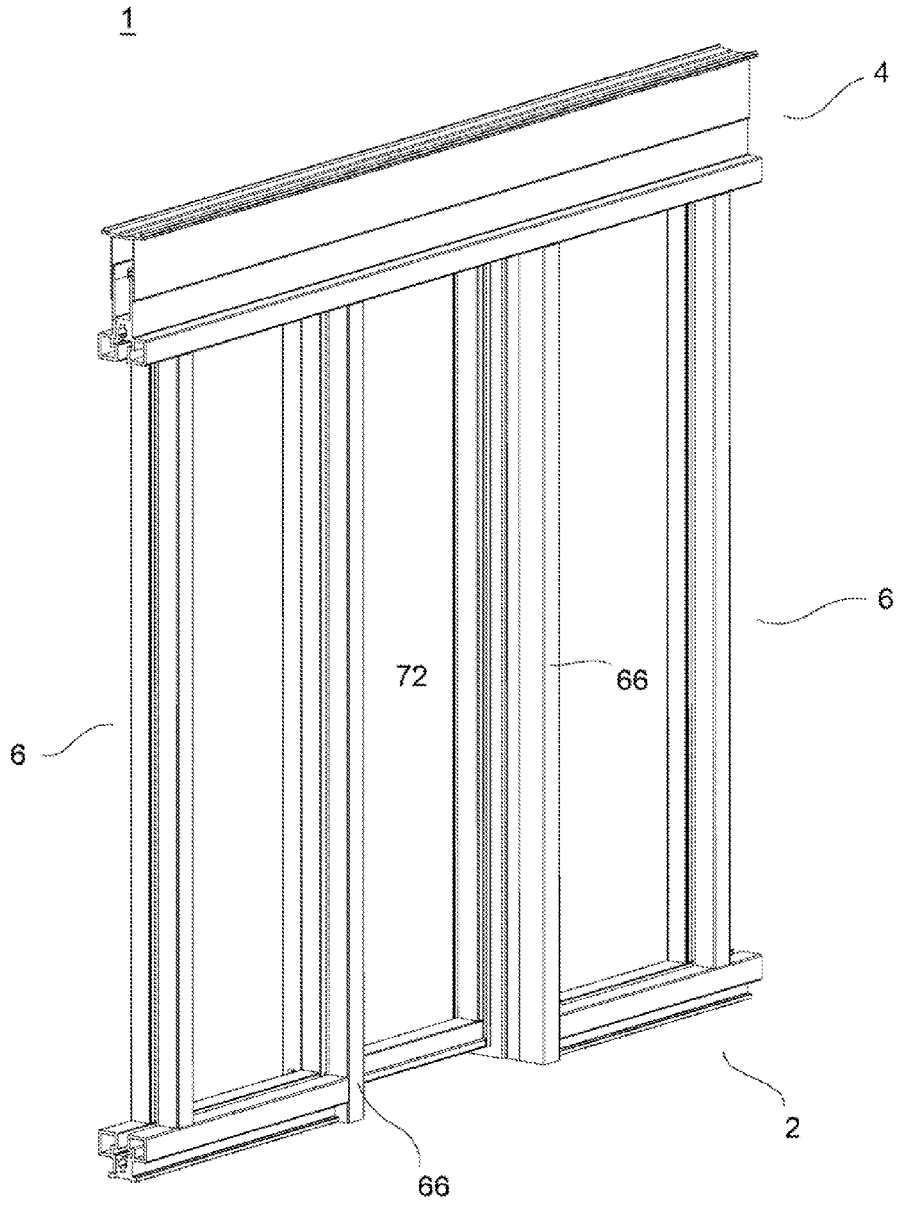
FIG. 26 is a perspective view of a second side of the frame of FIG. 23.

The frame structure 1 described up to now is particularly indicated for receiving a door 62, according to an embodiment indicated in FIGS. 6, 7, 8, 9, and 23, 24, 25, 26.

According to such embodiment, the frame 1 comprises at least one end post 66, connected to the ends of the base 2 and to the cross member 4, comprising a door half-post 63 and a room half-post 64.

In an embodiment of the invention, the door half-post 63 is connected to the room half-post 64 by means of screws. For such purpose, the door half-post 63 has on a side facing the door, through holes 24 for screws, with a recess suitable for accommodating the heads of the screws, positioned at the screw seats obtained on the room half-post 64.

Analogously to the description outlined for the post 6, the end post 66 comprises an end pane seat 65, defined by two facing and parallel pane stop surfaces 67, obtained on a side facing the pane of the door half-post 63 and of the room half-post 64.

In an embodiment of the invention, the pane stop surfaces 67 are defined by cantilevered portions 68, obtained on the door half-post 63 and on the room half-post 64, overhanging in the direction of the pane.

In an embodiment of the invention, each post pane surface 67 of the end pane seat 65 is provided with a gasket 25, extended along a larger portion of the post pane surface 67, and having a thickness such that, in a use configuration of the frame 1, i.e. when the door half-post 63 is fastened onto the room half-post 64 and the pane is secured to the frame 1, the main pane surface is in pressing contact with the gasket 25, while the cantilevered portions 68 of the door and room half-posts 63,64 are in proximity to the main pane surface, without contact thereon.

According to an embodiment of the present invention, the gaskets 25 are made of polymeric material, for example in polyurethane, with high density and high coefficient of friction.

The door 62 has an upper base 81 and a lower base 73 facing the floor, with a first groove 74 suitable to receive and lock a touch guillotine 75 displaceable in the first groove 74, in such a manner to allow the setting of the gap between the door and the floor.

The touch guillotine 75 is provided with a channel 76, obtained on the side of the guillotine 75 facing the floor, suitable to receive a brush gasket (not shown) capable of obtaining a sliding contact with the floor.

The door 62 may be configured as a sliding door 72 or hinged door 71.

In cases where the door 62 is configured as a sliding door 72, the upper base 81 has wheels 80, sliding on a support bar 82 fixed to the cross member 4 of the frame 1.

Advantageously, the lower base 73 further comprises a second groove 77 suitable to guarantee a sleeve-coupling with a guide pin 78 of an anti-sway bracket 79 internally fixed to the door half-post 63, in such a manner to withhold the lower base 73 near the frame 1 and thus avoid the swaying of the sliding door 72.

In an embodiment of the invention, the door half-post 63 of the end post 66 to which the anti-sway bracket 79 connected, comprises a brush gasket 85, connected through snap-fitting means, for example by means of a snap-on connection, to a side of the door half-post 63 facing the sliding door 72, suitable to come to friction contact with a friction surface 86 of the sliding door 72, when the sliding door 72 is closed.

Advantageously, the door half-post 63 of the end post 66 not connected to the sliding door 72, comprises a gasket with an air chamber 69 connected through snap-fitting means, for example by means of a snap-on connection, to an abutment side of the door half-post 63 not connected to the door 62, suitable to come into pressing contact with a corresponding abutment surface 70 of the sliding door 72.

Should the door 62 be configured as a hinged door 71, the upper base 81 is advantageously connected to an arm 83 of a return mechanism 84, fixed onto the cross member 4 of the frame 1.

In an embodiment of the invention, the door half-post 63 of the end post 66 connected to the hinged door 71, comprises connection hinges, and a gasket with an air chamber 69, connected through snap-fitting means, for example by means of a snap-on connection, to a side of the door half-post 63 facing the hinged door 71 and substantially perpendicular to the advancement direction of the hinged door 71, suitable for pressure-contacting an abutment surface 70 of the hinged door 71.

The gasket with an air chamber 69 faces the abutment surface 70 in such a manner that, when the hinged door 71 is moved to close, it is compressed by the abutment surface 70, avoiding frictions between the gasket with an air chamber 69 and the abutment surface 70.

Analogously, the door half-post 63 of the end post 66 not connected to the hinged door 71, comprises a gasket with an air chamber 69 connected through snap-fitting means (snap-on) to an abutment side of the door half-post 63 not connected to the hinged door 71 and substantially perpendicular to the advancement direction of the hinged door 71, suitable for pressure-contacting an abutment surface 70 of the hinged door 71.

The gasket with an air chamber 69 faces the abutment surface 70 in such a manner that, when the hinged door 71 is moved to close, it is compressed by the abutment surface 70, avoiding frictions between the gasket with an air chamber 69 and the abutment surface 70.

Following is a description of the assembly of the frame structure 1 according to the present invention, for exemplification purposes, considering only one post 6.

Firstly, the two half-bases 35,38 and the two semi-cross members 44,48 are assembled.

The post 6 is assembled by sliding the reinforcing bar 9 in the concavity 12 of the first half-post 10 in a direction of the longitudinal axis 200 of the post 6, and subsequently coupling the side portion 14 of the reinforcing bar 9 that was left free to the second half-post 11.

Subsequently, the base 2 is fixed to the floor and the cross member 4, with the capsized U-shaped element 51 thereof, is secured to the ceiling at a vertical position overlying the base 2.

The post 6, with the coupling portions 29,30 aligned to the direction of longitudinal extension of the base 2 and of the cross member 4, is thus rotated in the plane of the frame, in such a manner that the coupling portions 29,30 are inserted into the undercut coupling seats 27,28.

The post 6 is thus moved to its operating position, by sliding the coupling portions 29,30 at the release position in the undercut coupling seats 27,28.

At this point, the post 6 is rotated by ninety degrees around its longitudinal axis 200 and moved to the engaging position in such a manner that the post pane seats 7 are aligned with the base pane seats 3 and cross member 5.

Alternatively, the coupling portions 27,28 of the post 6 may be inserted into the undercut coupling seats 29,30 at an end point of the longitudinal extension of the base 2 and of the cross member 4 already at the engaging position.

It should be observed that should one want to change the operating position of the post 6, for example to insert a pane having a different width, all that is required is to rotate the post 6 to the release position, search the operating position and rotate the post 6 to engaging position again.

The clearance present between the coupling portions 29,30 and the undercut coupling seats 27,28 allows even minimum adjustments of the operating position of the post 6, by sliding the undercut coupling portions 27,28 directly to the engaging position.

Furthermore, such clearance allows a movement of the post 6 in a direction transverse to the direction of extension of the base 2 and cross member 4, with the aim of compensating possible errors when positioning the cross member 4 vertically overlying the base 2.

After the post 6 has been assembled to the frame 1, the pane is inserted into the pane seats 3,5,7 and the fixing screws are fastened in such a manner that, due to the gaskets 25, the pane is firmly held onto the frame 1.

The frame 1 according to the present invention has various advantages, in particular it has a structure that is easy to assemble, with a high degree of safety.

The frame 1 is easy to disassemble and it is therefore particularly indicated for uses that require frequently varying the position of the moveable wall.

The frame 1 guarantees high soundproof properties.

Lastly, the frame 1, due to the concealed arrangement of the fastening screws, it has a particularly clean aesthetic aspect.

Obviously, the frame structure according to the present invention, may be subjected—by a man skilled in the art with the aim of meeting contingent and specific requirements—to further modifications and variants all falling within the scope of protection of the invention, as defined by the claims that follow.

For example, according to an embodiment, said secondary semi-cross member 48 comprises a rib 52 suitable to cooperate with a groove 53 of said primary semi-cross member 44.

According to an embodiment, said primary semi-cross member 44 comprises a trunk 46 suitable to slide telescopically in a compartment 47 of a capsized U-shaped element 51 fixed onto the ceiling.

According to an embodiment, said trunk 46 of said primary semi-cross member 44 comprises a wall 54 with a channel 56 for a yielding gasket suitable to obtain contact with a wall of said capsized U-shaped element 51. According to an embodiment, said first and second half-post 10, 11, said primary 35 and secondary 38 half-base, said primary 44 and secondary 48 semi-cross member, said door 63 and room 64 half-posts are made of aluminium and said reinforcing bar 9 is made of iron.

According to an embodiment, said secondary half-base 38, said secondary semi-cross member 48, said second half-post 11, said door half-post 63 are fixed, respectively, to said primary half-base 35, said primary semi-cross member 44, said first half-post 11, said room half-post 64 by means of screws arranged in a portion thereof not visible by a person under the normal conditions of use of the frame 1.

According to an embodiment, said frame 1 comprises a door 62, with a lower base 73, said lower base 73 comprising a first groove 74 suitable to receive and lock a touch guillotine 75, said touch guillotine 75 comprising a brush gasket. According to an embodiment, said door 62 is configured as a sliding door 72, said sliding door 72 comprising a second groove 77 suitable to guarantee a sleeve-coupling with a guide pin 78 of an anti-sway bracket 79 internally fixed to said door half-post 63.

According to an embodiment, said door 62 is configured as a sliding door 72, said door half-post 63 comprising a brush gasket 85 suitable to come to friction contact with a friction surface 86 of the sliding door 72.

According to an embodiment, said door 62 is configured as a sliding door 72, said door half-post 63 comprising a gasket with an air chamber 69 suitable to come into pressing contact with a corresponding abutment surface 70 of said sliding door 72.

According to an embodiment, said door 62 is configured as a hinged door 71, said door half-post 63 comprising a gasket with an air chamber 69 connected to a side of said door half-post 63 substantially perpendicular to the advancement direction of the hinged door 71, suitable for pressure-contacting an abutment surface 70 of said hinged door 71, avoiding frictions between said gasket with an air chamber 69 and said abutment surface 70.

The invention claimed is:

1. A modular frame structure (1) for a wall in glass or other pane material, comprising:

a base (2) extending along a predefined first longitudinal axis (100), with a base pane seat (3) suitable to receive and lock an edge portion of a pane, a cross member (4) extending along a predefined second longitudinal axis (100'), with a cross member pane seat (5) suitable to receive and lock an edge portion of a pane, one or more posts (6), extending along a vertical axis (200), suitable to form at least one side of the frame (1), with at least one post pane seat (7) suitable to receive and lock a portion of a pane, connecting means (8), suitable to ensure a connection between said posts (6) and said base (2) and cross member (4), wherein:

said posts (6) comprise a reinforcing bar (9) suitable to confer stiffness to said frame structure (1), said connecting means (8) comprise a first undercut coupling seat (27) obtained on said base (2), a second undercut coupling seat (28) obtained on said cross member (4), said first and second undercut coupling seats (27, 28) extending, respectively, along said longitudinal axis (100, 100') of said base (2) and cross member (4) and first and second coupling portions (29, 30) of said post (6), said first coupling portion (29) being insertable in said first undercut coupling seat (27) in any points of said longitudinal axis (100), said second coupling portion (30) being insertable in said second undercut coupling seat (28) in any points of said longitudinal axis (100'), said first and second coupling portions (29, 30) being selectively movable between a release position, in which said first and second coupling portions (29, 30) do not engage said first and second undercut coupling seats (27, 28), respectively, and an engaging position, in which said first and second coupling portions (29, 30) engage said first and second undercut coupling seats (27, 28), respectively wherein:

said base pane seat (3) is defined by two facing and parallel pane stop surfaces (31) suitable to receive and lock an edge portion of a pane, said cross member pane seat (5) is defined by two facing and parallel pane stop surfaces (32) suitable to receive and lock an edge portion of a pane, said post (6) comprises a first and a second half-posts (10, 11) connected to said reinforcing bar (9), said first and second half-posts (10, 11) comprising a concavity (12, 13) suitable to receive a side portion (14) of said reinforcing bar (9), and said first and second coupling portions (29, 30) of the post (6) are configured as end portions of said reinforcing bar (9).

2. The frame structure (1) according to claim 1, wherein said first undercut coupling seat (27) is adjacent to said base pane seat (3), and said second undercut coupling seat (28) is adjacent to said cross member pane seat (5).

3. The frame structure (1) according to claim 1, wherein said cross member (4) comprises a primary semi-cross member (44), with a head portion (45) and a secondary semi-cross member (48), with a head portion (49), said cross member pane seat (5) being obtained in a gap between said head portion (45) of the primary semi-cross member (44) and said head portion (40) of the secondary semi-cross member (48), and being defined by two facing and parallel pane stop surfaces (32), said pane stop surfaces (32) being defined by portions (57) of the semi-cross members (44, 48) overhanging in the direction of the pane.

4. The frame structure (1) according to claim 1, wherein said at least one post pane seat (7) comprises two post pane seats (7), each with a pane stop surface (22) of a first half-post (10) of said post (6) and a pane stop surface (23) of a second half-post (11) of said post (6), said pane stop surfaces (22, 23) being defined by portions (26) overhanging in the direction of the pane, said pane stop surface (22) of said first half-post (10) facing and being parallel to said pane stop surface (23) of said second half-post (11).

5. The frame structure (1) according to claim 1, wherein said coupling portions (29, 30) are "T"-shaped.

6. The frame structure (1) according to claim 1, wherein said first half-post (10) is connected to said reinforcing bar (9) through a track (17) and slot (18) connection.

7. The frame structure (1) according to claim 1, further comprising at least one end post (66), connected to one end of said base (2) and to said cross member (4), said end post comprising a first half-post (63) and a second half-post (64), and an end pane seat (65), defined by two facing and parallel pane stop surfaces (67), on the door half-post (63) and the room half-post (64) respectively.

8. The frame structure (1) according to claim 7, wherein said pane stop surfaces have a gasket (25) in pressing contact with a pane main surface.

9. The frame structure according to claim 8, wherein said gasket (25) is made of a high-density, high friction coefficient polymeric material.

10. A modular frame structure (1) for a wall in glass or other pane material, comprising:

a base (2) extending along a predefined first longitudinal axis (100), with a base pane seat (3) suitable to receive and lock an edge portion of a pane, a cross member (4) extending along a predefined second longitudinal axis (100'), with a cross member pane seat (5) suitable to receive and lock an edge portion of a pane, one or more posts (6), extending along a vertical axis (200), suitable to form at least one side of the frame (1), with at least one post pane seat (7) suitable to receive and lock a portion of a pane, connecting means (8), suitable to ensure a connection between said posts (6) and said base (2) and cross member (4), wherein:

said posts (6) comprise a reinforcing bar (9) suitable to confer stiffness to said frame structure (1), said connecting means (8) comprise a first undercut coupling seat (27) disposed on said base (2), a second undercut coupling seat (28) disposed on said cross member (4), said first and second undercut coupling seats (27, 28) extending, respectively, along said longitudinal axis (100, 100') of said base (2) and cross member (4) and first and second coupling portions (29, 30) of said post (6), said first coupling portion (29) being insertable in said first undercut coupling seat (27) in any points of said longitudinal axis (100), said second coupling portion (30) being insertable in said second undercut coupling seat (28) in any points of said longitudinal axis (100'), said first and second coupling portions (29, 30) being selectively movable between a release position, in which said first and second coupling portions (29, 30) do not engage said first and second undercut coupling seats (27, 28), respectively, and an engaging position, in which said first and second coupling portions (29, 30) engage said first and second undercut coupling seats (27, 28), respectively wherein said base (2) comprises a primary half-base (35) with a head portion (39), and a secondary half-base (38), with a head portion (40), said base pane seat (3) being disposed in a gap between said head portion (39) of the primary half-base (35) and said head portion (40) of the secondary half-base (38), and being defined by two facing and parallel pane stop surfaces (31), said pane stop surfaces (31) being defined by portions (34) of said primary and secondary half-bases (35, 38) overhanging in the direction of the pane and said secondary half-base (38) comprises a rib (42) suitable to cooperate with a groove (43) of said primary half-base (35).

* * * * *